US011906160B2

(12) United States Patent
Kendrick

(10) Patent No.: US 11,906,160 B2
(45) Date of Patent: Feb. 20, 2024

(54) COMBUSTION SYSTEM INCLUDING A MIXING TUBE AND A FLAME HOLDER

(71) Applicant: ClearSign Technologies Corporation, Seattle, WA (US)

(72) Inventor: Donald Kendrick, Bellevue, WA (US)

(73) Assignee: ClearSign Technologies Corporation, Tulsa, OK (US)

( * ) Notice: Subject to any disclaimer, the term of this patent is extended or adjusted under 35 U.S.C. 154(b) by 983 days.

(21) Appl. No.: 16/678,120

(22) Filed: Nov. 8, 2019

(65) Prior Publication Data

US 2020/0141573 A1 May 7, 2020

Related U.S. Application Data

(63) Continuation-in-part of application No. PCT/US2018/031449, filed on May 7, 2018.
(Continued)

(51) Int. Cl.

| | |
|---|---|
| ***F23D 14/64*** | (2006.01) |
| ***F23C 9/00*** | (2006.01) |
| ***F23D 11/10*** | (2006.01) |
| ***F23D 11/40*** | (2006.01) |
| ***F23D 14/02*** | (2006.01) |

(Continued)

(52) U.S. Cl.
CPC ..... *F23D 14/64* (2013.01); *F23C 9/00* (2013.01); *F23D 11/103* (2013.01); *F23D 11/402* (2013.01); *F23D 14/02* (2013.01); *F23D 14/70* (2013.01); *F23D 17/00* (2013.01); *F23D 2203/007* (2013.01); *F23D 2203/10* (2013.01); *F23D 2203/102* (2013.01); *F23D 2204/00* (2013.01); *F23D 2212/101* (2013.01)

(58) Field of Classification Search
CPC ..... F23D 14/70; F23D 14/64; F23D 14/02; F23D 11/402; F23D 11/103; F23C 9/00
USPC ..... 431/354–355, 329, 328, 12
See application file for complete search history.

(56) References Cited

U.S. PATENT DOCUMENTS

| | | | |
|---|---|---|---|
| 2,095,065 | A | 10/1937 | Hays |
| 2,635,813 | A | 4/1953 | Schlenz |

(Continued)

FOREIGN PATENT DOCUMENTS

| | | |
|---|---|---|
| EP | 0478305 | 12/1997 |
| EP | 1139022 | 10/2001 |

(Continued)

OTHER PUBLICATIONS

PCT International Search Report and Written Opinion dated Aug. 30, 2018, for PCT International Patent Application No. PCT/US2018/031449, filed May 7, 2018, 31 pages.

(Continued)

*Primary Examiner* — Vivek K Shirsat
(74) *Attorney, Agent, or Firm* — LaunchpadIP, Inc.; Christopher A. Wiklof; Harold H. Bennett, II

(57) ABSTRACT

A combustion system includes a fuel distributor configured to output a fuel, an oxidant source configured to output an oxidant, and a mixing tube defining a mixing volume aligned to receive the fuel and oxidant. The mixing tube is shaped to convey the fuel and the oxidant through the mixing volume at a bulk velocity higher than a flame propagation speed. The combustion system includes a flame holder aligned to receive the mixed fuel and oxidant and to support a combustion reaction of the fuel and the oxidant.

43 Claims, 23 Drawing Sheets

Related U.S. Application Data

(60) Provisional application No. 62/502,869, filed on May 8, 2017.

(51) Int. Cl.
*F23D 14/70* (2006.01)
*F23D 17/00* (2006.01)

(56) References Cited

U.S. PATENT DOCUMENTS

| | | | | |
|---|---|---|---|---|
| 2,828,813 | A | 4/1958 | Holden | |
| 2,879,862 | A | 3/1959 | Burden, Jr. | |
| 3,008,513 | A | 11/1961 | Holden | |
| 3,076,605 | A | 2/1963 | Holden | |
| 4,443,182 | A | 4/1984 | Wojcieson et al. | |
| 4,473,349 | A | 9/1984 | Kumatsu | |
| 4,483,673 | A | 11/1984 | Murai et al. | |
| 4,519,770 | A | 5/1985 | Kesselring et al. | |
| 4,643,667 | A | 2/1987 | Fleming | |
| 4,673,349 | A | 6/1987 | Abe et al. | |
| 4,752,213 | A | 6/1988 | Grochowski et al. | |
| 4,872,833 | A * | 10/1989 | Kramer | B01F 25/3121 431/354 |
| 4,899,696 | A | 2/1990 | Kennedy et al. | |
| 5,409,375 | A | 4/1995 | Butcher | |
| 5,458,484 | A | 10/1995 | Ripka | |
| 5,624,253 | A * | 4/1997 | Sulzhik | F23C 9/00 431/348 |
| 5,641,282 | A | 6/1997 | Lee et al. | |
| 5,718,573 | A | 2/1998 | Knight et al. | |
| 5,993,192 | A | 11/1999 | Schmidt et al. | |
| 6,065,963 | A | 5/2000 | Dewaegheneire et al. | |
| 6,140,658 | A | 10/2000 | Jarvinen | |
| 6,210,151 | B1 | 4/2001 | Joshi et al. | |
| 6,752,620 | B2 | 6/2004 | Heier et al. | |
| 6,997,701 | B2 | 2/2006 | Volkert et al. | |
| 2003/0054301 | A1 | 3/2003 | Borders et al. | |
| 2006/0292510 | A1 | 12/2006 | Krauklis et al. | |
| 2008/0131824 | A1 | 6/2008 | Wahl et al. | |
| 2010/0126175 | A1 | 5/2010 | Kim et al. | |
| 2010/0178219 | A1 | 7/2010 | Verykios et al. | |
| 2012/0064465 | A1 | 3/2012 | Borissov et al. | |
| 2012/0270161 | A1 | 10/2012 | Poe et al. | |
| 2014/0260299 | A1 | 9/2014 | Boardman et al. | |
| 2016/0025333 | A1 | 1/2016 | Karkow et al. | |
| 2016/0040872 | A1 | 2/2016 | Colannino et al. | |
| 2016/0146468 | A1* | 5/2016 | Gao | F23C 7/002 60/742 |
| 2016/0298840 | A1 | 10/2016 | Karkow et al. | |
| 2016/0348900 | A1 | 12/2016 | Colannino et al. | |
| 2017/0010019 | A1 | 1/2017 | Karkow et al. | |
| 2017/0051913 | A1 | 2/2017 | Colannino et al. | |
| 2017/0307212 | A1 | 10/2017 | Kendrick | |
| 2018/0003378 | A1 | 1/2018 | Karkow et al. | |
| 2018/0038588 | A1 | 2/2018 | Karkow et al. | |
| 2018/0066846 | A1 | 3/2018 | Karkow et al. | |
| 2018/0087774 | A1 | 3/2018 | Karkow et al. | |
| 2018/0202653 | A1 | 7/2018 | Karkow | |
| 2019/0011123 | A1 | 1/2019 | Dansie et al. | |
| 2019/0257516 | A1 | 8/2019 | Karkow et al. | |
| 2019/0368723 | A1 | 12/2019 | Kendrick et al. | |

FOREIGN PATENT DOCUMENTS

| | | |
|---|---|---|
| EP | 1916477 | 4/2008 |
| EP | 2738460 | 6/2014 |
| WO | WO 1995/000803 | 1/1995 |
| WO | WO 2015/054323 | 4/2015 |
| WO | WO 2018/160869 | 9/2018 |

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

Arnold Schwarzenegger, "A Low NOx Porous Ceramics Burner Performance Study," California Energy Commission Public Interest Energy Research Program, Dec. 2007, San Diego State University Foundation.

* cited by examiner

COMBUSTION SYSTEM INCLUDING A MIXING TUBE AND A FLAME HOLDER

CROSS REFERENCE TO RELATED APPLICATIONS

The present application is a Continuation-in-Part Application which claims priority benefit under 35 U.S.C. § 120 (pre-AIA) of International Patent Application No. PCT/US2018/031449, entitled "COMBUSTION SYSTEM INCLUDING A MIXING TUBE AND A PERFORATED FLAME HOLDER," filed May 7, 2018. International Patent Application No. PCT/US2018/031449 claims priority benefit from U.S. Provisional Patent Application No. 62/502,869, entitled "COMBUSTION SYSTEM INCLUDING A MIXING TUBE AND A PERFORATED FLAME HOLDER," filed May 8, 2017; which, to the extent not inconsistent with the disclosure herein, is incorporated by reference.

SUMMARY

According to an embodiment, a combustion system includes a fuel distributor configured to output a fuel, an oxidant source configured to output an oxidant, and a mixing tube defining a mixing volume aligned to receive the fuel and the oxidant. The mixing tube is shaped to convey the fuel and the oxidant through the mixing volume at a bulk velocity higher than a flame propagation speed. The mixing tube is sized for a residence time shorter than a chemical ignition delay time of the fuel and the oxidant traversing the mixing volume. The combustion system includes a flame holder aligned to receive the mixed fuel and the oxidant. The flame holder is configured to support a combustion reaction within or adjacent to the flame holder.

According to an embodiment, a method includes introducing an oxidant into a mixing tube, introducing a fuel into a mixing tube, and mixing the fuel and the oxidant by passing the fuel and the oxidant through the mixing tube at a bulk velocity higher than a flame propagation speed and with a residence time shorter than a chemical ignition delay time of the fuel and the oxidant traversing the mixing volume. The method also includes outputting the mixed fuel and the oxidant from an output end of the mixing tube, receiving the mixed fuel and the oxidant at a flame holder, and supporting a combustion reaction within or adjacent to the flame holder.

According to an embodiment, a combustion system includes a fuel distributor configured to output a fuel, an oxidant source configured to output an oxidant, and a mixing tube defining a mixing volume aligned to receive the fuel and the oxidant and shaped to convey the fuel and the oxidant to an output end of the mixing tube. The combustion system includes a flame holder. The flame holder includes a central portion facing the output end of the mixing tube and a peripheral portion at least partially surrounding the mixing tube. The central portion and the peripheral portion each are aligned to receive respective portions of the mixed fuel and the oxidant and to support a combustion reaction of the mixed fuel and the oxidant within or adjacent to the flame holder.

According to an embodiment, a combustion system includes a fuel distributor configured to output a fuel, an oxidant source configured to output an oxidant, and a mixing tube defining a mixing volume aligned to receive the fuel and the oxidant. The mixing tube is shaped to convey the fuel and the oxidant through the mixing volume at a bulk velocity higher than a flame propagation speed. The combustion system also includes a flame holder aligned to receive a mixture of the fuel and the oxidant from the mixing tube. The flame holder is configured to support a combustion reaction of the mixture of the fuel and the oxidant within or adjacent to the flame holder.

According to an embodiment, a combustion system includes a fuel distributor configured to output a fuel and an oxidant source configured to output an oxidant. The combustion system also includes a mixing tube defining a mixing volume aligned to receive the fuel and the oxidant. The mixing tube is sized for a residence time shorter than a chemical ignition delay time of the fuel and the oxidant traversing the mixing volume. The combustion system also includes a flame holder aligned to receive a mixture of the fuel and the oxidant from the mixing tube. The flame holder is configured to support a combustion reaction of the mixture of the fuel and the oxidant within or adjacent to the flame holder.

DETAILED DESCRIPTION

Figure 1A:
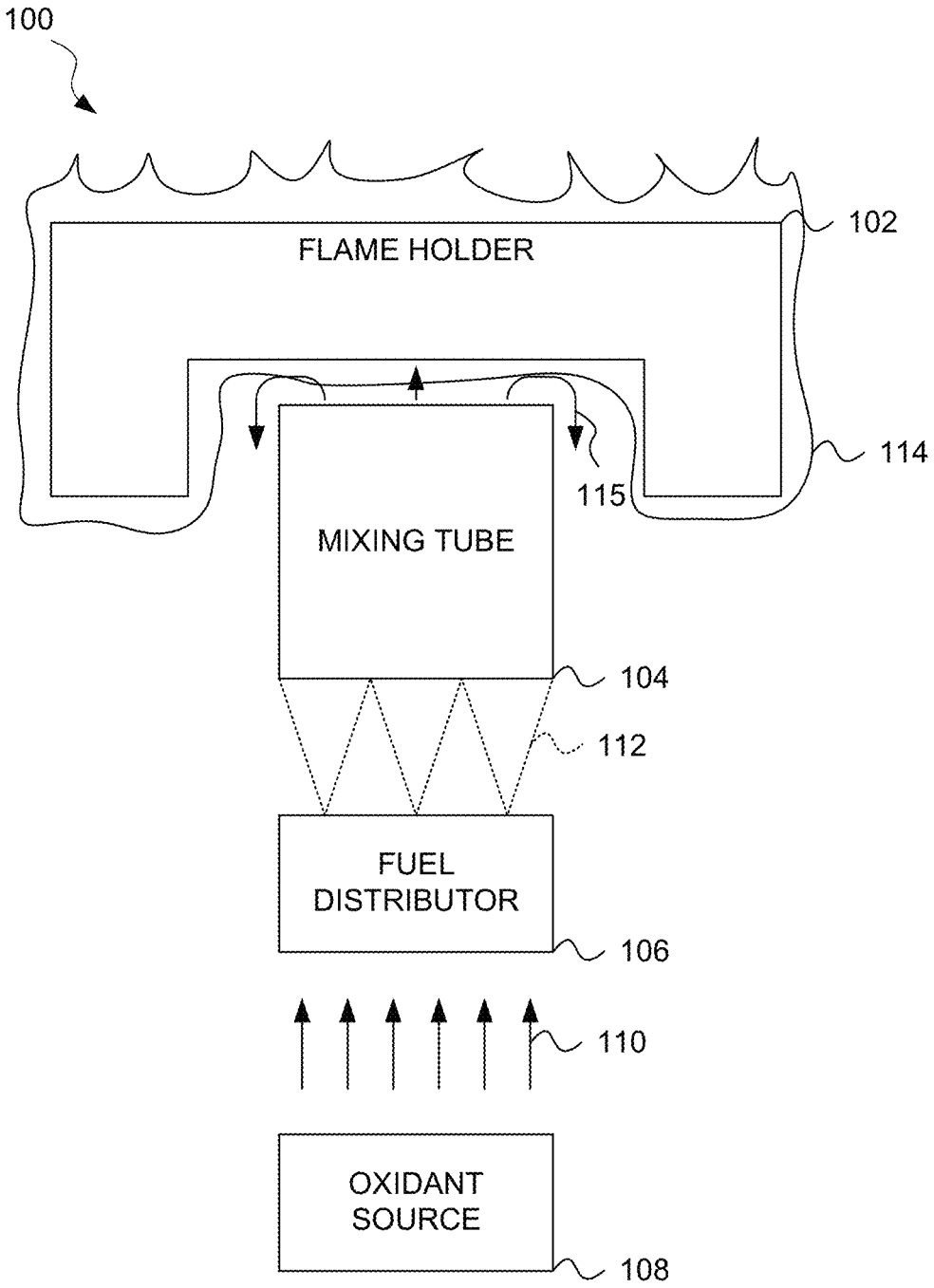
FIG. 1A is a block diagram of a combustion system, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1A is a block diagram of a combustion system 100, according to an embodiment. The combustion system 100 includes a flame holder 102, a mixing tube 104, a fuel distributor 106, and an oxidant source 108, according to an embodiment.

According to an embodiment, the oxidant source 108 outputs an oxidant 110. The oxidant 110 enters the mixing tube 104. According to an embodiment, the oxidant 110 travels from the oxidant source 108 into the mixing tube 104 via an opening in the mixing tube 104. According to an embodiment, a portion of the oxidant source 108 is positioned within the mixing tube 104 such that the oxidant source 108 directly outputs the oxidant 110 into the mixing tube 104.

According to an embodiment, the fuel distributor 106 outputs a fuel 112 into the mixing tube 104. According to an embodiment, the fuel distributor 106 outputs the fuel 112 from a position exterior to the mixing tube 104 and the fuel 112 travels toward the mixing tube 104 and enters into the mixing tube 104 via an input opening in the mixing tube 104. Alternatively, a portion of the fuel distributor 106 can be positioned within the mixing tube 104 such that the fuel distributor 106 outputs the fuel 112 directly within the mixing tube 104.

According to an embodiment, the interior of the mixing tube 104 is a mixing volume configured to mix the fuel 112 and the oxidant 110 prior to being received by the flame holder 102. As the fuel 112 and the oxidant 110 travel through the mixing tube 104 toward an output end of the mixing tube 104, the fuel 112 and the oxidant 110 mix together.

According to an embodiment, the flame holder 102 is aligned to receive the mixture of the fuel 112 and the oxidant 110 from the mixing tube 104. The flame holder 102 receives the mixture of the fuel 112 and the oxidant 110 and supports or holds a combustion reaction 114 of the fuel 112 and the oxidant 110. According to an embodiment, the flame holder 102 can sustain the combustion reaction 114 upstream and/or downstream from the flame holder 102. According to an embodiment, the flame holder 102 can also support the combustion reaction 114 in gaps between individual sections or tiles of the flame holder 102.

According to an embodiment, at least a portion of the flame holder 102 is aligned to receive the mixed fuel 112 and the oxidant 110 along an axis common to the mixing volume and/or the mixing tube 104. This portion of the flame holder 102 can receive the oxidant 110 and the fuel 112 in a substantially linear trajectory in a direction of the axis of the mixing tube 104. This portion of the flame holder 102 can be axially aligned with the mixing tube 104. The portion of the flame holder 102 that is axially aligned with the mixing tube 104 supports at least a portion of the combustion reaction 114. The mixing tube 104 can define a mixing tube 104 output axis characteristic of an average direction of transport of the mixed fuel 112 and the oxidant 110 from the mixing tube 104.

According to an embodiment, at least a portion of the flame holder 102 is positioned peripherally to an output opening of the mixing tube 104. The combustion system 100 can include flow diverters configured to divert at least a portion of the mixed fuel 112 and the oxidant 110 exiting the mixing tube 104 to those portions of the flame holder 102 that are located peripherally from an output opening of the mixing tube 104. According to an embodiment, in the absence of the flow diverters, all of the fuel 112 and the oxidant 110 may be received by those portions of the flame holder 102 positioned directly above the output opening of the mixing tube 104. Because the combustion system 100 includes flow diverters, a portion of the fuel 112 and the oxidant 110 is diverted to those portions of the flame holder 102 that are located peripherally to an output opening of the mixing tube 104. The peripheral portions of the flame holder 102 receive a portion of the fuel 112 and the oxidant 110 and support a portion of the combustion reaction 114 peripherally to the mixing tube 104.

According to an embodiment, a peripheral portion of the flame holder 102 laterally surrounds a portion of the mixing tube 104. Thus, the peripheral portion of the flame holder 102 is positioned outside of the mixing tube 104 at a level lower than the output opening of the mixing tube 104. In this case, a portion of the fuel 112 and the oxidant 110 flows from the output opening of the mixing tube 104, is diverted from a primary direction of flow of the mixture of the fuel 112 and the oxidant 110, and flows downward along an external wall of the mixing tube 104 along a transport path that is antiparallel and circumferential to the mixing tube 104 output axis. The peripheral portion of the flame holder 102 receives the mixture of the fuel 112 and the oxidant 110 and sustains a portion of the combustion reaction 114.

According to an embodiment, the flame holder 102 is arranged circumferentially to, and spaced away from, the mixing tube 104 and to define an annular volume between the flame holder 102 and the mixing tube 104, such that the diverted mixed fuel 112 and the oxidant 110 is delivered through the annular volume to an input face of the flame holder 102. According to an embodiment, the input face of the flame holder 102 is cylindrical. According to an embodiment, the input face of the flame holder 102 is faceted. According to an embodiment, the input face of the flame holder 102 is conical.

According to an embodiment, the entirety of the flame holder 102 is positioned peripherally to the output opening of the mixing tube 104. In this case, the entirety of the mixture of the fuel 112 and the oxidant 110 is diverted to the flame holder 102 peripherally to an output opening of the mixing tube 104.

According to an embodiment, the mixing tube 104 is shaped to convey the fuel 112 and the oxidant 110 at a bulk velocity higher than a flame propagation speed. The mixing tube 104 is sized for a residence time shorter than a chemical ignition delay time of the fuel 112 and the oxidant 110 traversing the mixing volume.

According to an embodiment, the fuel distributor 106 includes mixing features configured to impart streamwise vortices to the fuel 112 and the oxidant 110. The streamwise vortices can enhance mixing of the fuel 112 and the oxidant 110 within the mixing tube 104. This can allow the mixing tube 104 to have a shorter length.

According to an embodiment, the oxidant source 108 includes mixing features configured to impart streamwise vortices to the fuel 112 and the oxidant 110. The streamwise vortices can enhance mixing of the fuel 112 and the oxidant 110 within the mixing tube 104. This can allow the mixing tube 104 to have a shorter length.

According to an embodiment, the flow diverters include a flat plate. Upon exiting the mixing tube 104, the mixed fuel 112 and the oxidant 110 impinge upon the flat plate and are diverted peripherally to the flame holder 102. In this way, the flat plate diverts the flow of the fuel 112 and the oxidant 110 toward the flame holder 102.

According to an embodiment, the flow diverter includes a coanda surface. According to an embodiment, the flow diverter includes one or more bluff bodies.

According to an embodiment, the alignment of the mixing tube 104 and the flame holder 102 is asymmetric.

According to an embodiment, the fuel 112 and the oxidant 110 mixture is greater than 70% PHI. PHI is a combustion equivalence ratio.

According to an embodiment, the mixing tube 104 is configured to recirculate flue gas into the mixing volume. According to an embodiment, the mixing tube 104 includes one or more flue gas apertures configured to admit the flue gas into the mixing volume. According to an embodiment, the mixing tube 104 is configured to mix the flue gas with the fuel 112 and the oxidant 110 to generate a mixture 115 of the fuel 112 and the oxidant 110.

According to an embodiment, the flame holder 102 includes a bluff body flame holder. The bluff body flame holder can include one or more bluff bodies. The bluff bodies can be separated from each other by gaps.

According to an embodiment, each bluff body is a bluff body tile. The bluff body tiles can be substantially solid, non-porous tiles. The bluff body tiles can collectively hold a combustion reaction 114 of the fuel 112 and oxidant 110. The flame holder 102 can include multiple bluff body tiles or a single bluff body tile.

According to an embodiment, the flame holder 102 can include a perforated flame holder.

Figure 1B:
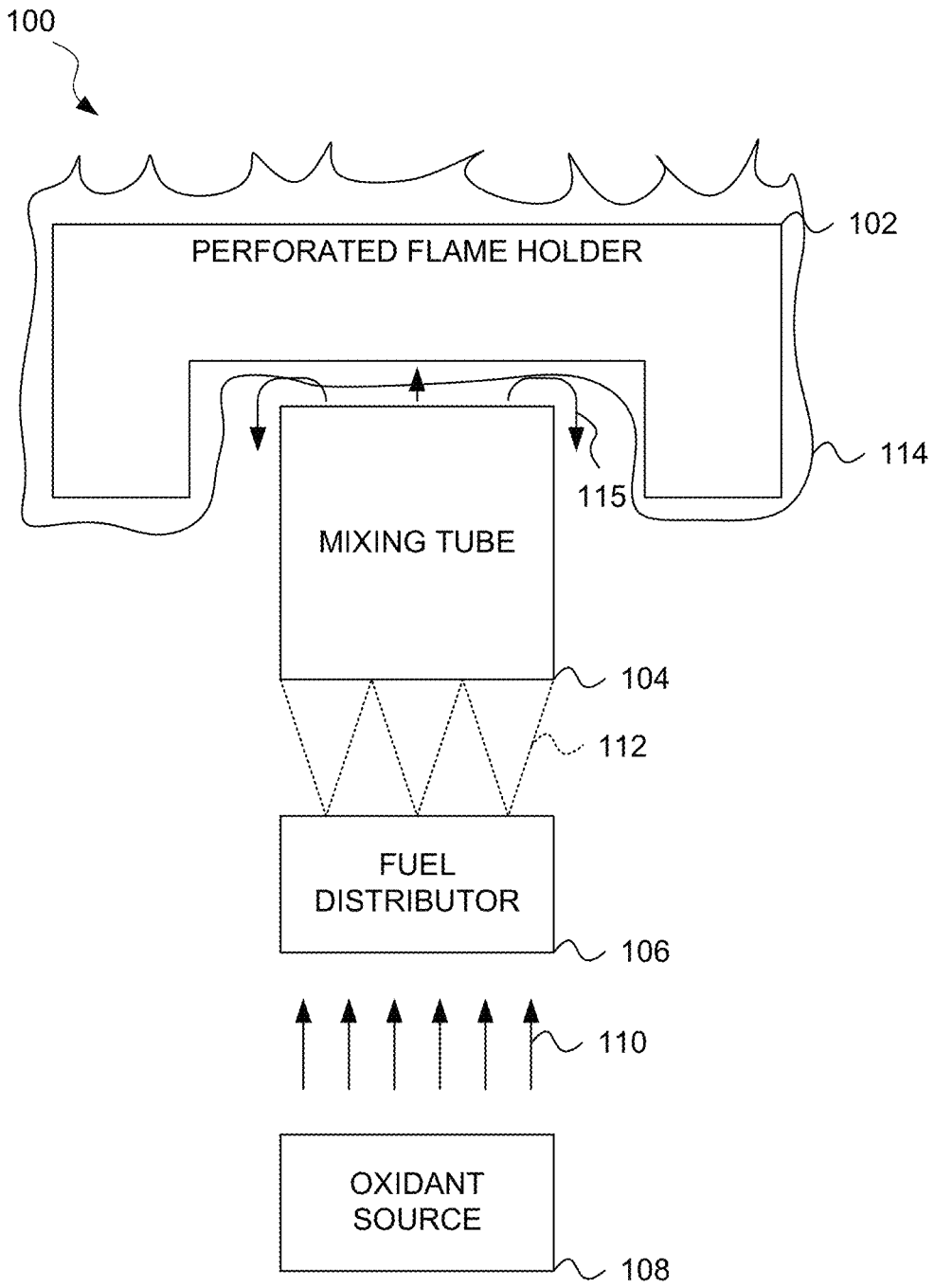
FIG. 1B is a block diagram of a combustion system, according to an embodiment.

FIG. 1B is a diagram of a combustion system 100, according to an embodiment. The combustion system 100 includes a perforated flame holder 102, a mixing tube 104, a fuel distributor 106, and an oxidant source 108, according to an embodiment.

According to an embodiment, the oxidant source 108 outputs an oxidant 110. The oxidant 110 enters the mixing tube 104. According to an embodiment, the oxidant 110 travels from the oxidant source 108 into the mixing tube 104 via an opening in the mixing tube 104. According to an embodiment, a portion of the oxidant source 108 is positioned within the mixing tube 104 such that the oxidant source 108 directly outputs the oxidant 110 into the mixing tube 104.

According to an embodiment, the fuel distributor 106 outputs a fuel 112 into the mixing tube 104. According to an embodiment, the fuel distributor 106 outputs the fuel 112 from a position exterior to the mixing tube 104 and the fuel 112 travels toward the mixing tube 104 and enters into the mixing tube 104 via an input opening in the mixing tube 104. Alternatively, a portion of the fuel distributor 106 can be positioned within the mixing tube 104 such that the fuel distributor 106 outputs the fuel 112 directly within the mixing tube 104.

According to an embodiment, the interior of the mixing tube 104 is a mixing volume configured to mix the fuel 112 and the oxidant 110 prior to being received by the perforated flame holder 102. As the fuel 112 and the oxidant 110 travel through the mixing tube 104 toward an output end of the mixing tube 104, the fuel 112 and the oxidant 110 mix together.

According to an embodiment, the perforated flame holder 102 is aligned to receive the mixture of the fuel 112 and the oxidant 110 from the mixing tube 104. The perforated flame holder 102 receives the mixture of the fuel 112 and the oxidant 110 and supports a combustion reaction 114 of the fuel 112 and the oxidant 110. According to an embodiment, the perforated flame holder 102 can sustain the combustion reaction 114 upstream, downstream, and/or within the perforated flame holder 102. According to an embodiment, the perforated flame holder 102 can also support the combustion reaction 114 in gaps between individual sections of the perforated flame holder 102.

According to an embodiment, at least a portion of the perforated flame holder 102 is aligned to receive the mixed fuel 112 and the oxidant 110 along an axis common to the mixing volume and/or the mixing tube 104. This portion of the perforated flame holder 102 can receive the oxidant 110 and the fuel 112 in a substantially linear trajectory in a direction of the axis of the mixing tube 104. This portion of the perforated flame holder 102 can be axially aligned with the mixing tube 104. The portion of the perforated flame holder 102 that is axially aligned with the mixing tube 104 supports at least a portion of the combustion reaction 114. The mixing tube 104 can define a mixing tube 104 output axis characteristic of an average direction of transport of the mixed fuel 112 and the oxidant 110 from the mixing tube 104.

According to an embodiment, at least a portion of the perforated flame holder 102 is positioned peripherally to an output opening of the mixing tube 104. The combustion system 100 can include flow diverters configured to divert at least a portion of the mixed fuel 112 and the oxidant 110 exiting the mixing tube 104 to those portions of the perforated flame holder 102 that are located peripherally from an output opening of the mixing tube 104. According to an embodiment, in the absence of the flow diverters, all of the fuel 112 and the oxidant 110 may be received by those portions of the perforated flame holder 102 positioned directly above the output opening of the mixing tube 104. Because the combustion system 100 includes flow diverters, a portion of the fuel 112 and the oxidant 110 is diverted to those portions of the perforated flame holder 102 that are located peripherally to an output opening of the mixing tube 104. The peripheral portions of the perforated flame holder 102 receive a portion of the fuel 112 and the oxidant 110 and support a portion of the combustion reaction 114 peripherally to the mixing tube 104.

According to an embodiment, a peripheral portion of the perforated flame holder 102 laterally surrounds a portion of the mixing tube 104. Thus, the peripheral portion of the perforated flame holder 102 is positioned outside of the mixing tube 104 at a level lower than the output opening of the mixing tube 104. In this case, a portion of the fuel 112 and the oxidant 110 flows from the output opening of the mixing tube 104, is diverted from a primary direction of flow of the mixture of the fuel 112 and the oxidant 110, and flows downward along an external wall of the mixing tube 104 along a transport path that is antiparallel and circumferential to the mixing tube 104 output axis. The peripheral portion of the perforated flame holder 102 receives the mixture of the fuel 112 and the oxidant 110 and sustains a portion of the combustion reaction 114.

According to an embodiment, the perforated flame holder 102 is arranged circumferentially to the mixing tube 104 and an annular volume such that the diverted mixed fuel 112 and the oxidant 110 is delivered through the annular volume to an input face of the perforated flame holder 102. According to an embodiment, the input face of the perforated flame holder 102 is cylindrical. According to an embodiment, the input face of the perforated flame holder 102 is faceted. According to an embodiment, the input face of the perforated flame holder 102 is conical.

According to an embodiment, the entirety of the perforated flame holder 102 is positioned peripherally to the output opening of the mixing tube 104. In this case, the entirety of the mixture of the fuel 112 and the oxidant 110 is diverted to the perforated flame holder 102 peripherally to an output opening of the mixing tube 104.

According to an embodiment, the mixing tube 104 is shaped to convey the fuel 112 and the oxidant 110 at a bulk velocity higher than a flame propagation speed. The mixing tube 104 is sized for a residence time shorter than a chemical ignition delay time of the fuel 112 and the oxidant 110 traversing the mixing volume.

According to an embodiment, the fuel distributor 106 includes mixing features configured to impart streamwise vortices to the fuel 112 and the oxidant 110. The streamwise vortices can enhance mixing of the fuel 112 and the oxidant 110 within the mixing tube 104. This can allow the mixing tube 104 to have a shorter length.

According to an embodiment, the oxidant source 108 includes mixing features configured to impart streamwise vortices to the fuel 112 and the oxidant 110. The streamwise vortices can enhance mixing of the fuel 112 and the oxidant 110 within the mixing tube 104. This can allow the mixing tube 104 to have a shorter length.

According to an embodiment, the flow diverters include a flat plate. Upon exiting the mixing tube 104, the mixed fuel 112 and the oxidant 110 impinge upon the flat plate and are diverted peripherally to the perforated flame holder 102. In this way, the flat plate diverts the flow of the fuel 112 and the oxidant 110 toward the perforated flame holder 102.

According to an embodiment, the flow diverter includes a coanda surface. According to an embodiment, the flow diverter includes one or more bluff bodies.

According to an embodiment, the alignment of the mixing tube 104 and the perforated flame holder 102 is asymmetric.

According to an embodiment, the fuel 112 and the oxidant 110 mixture is greater than 70% PHI. PHI is a combustion equivalence ratio.

According to an embodiment, the combustion system 100 includes a plurality of bluff body members positioned between the outer wall of the mixing tube 104 and the peripheral portion of the perforated flame holder 102. According to embodiment, the bluff body members are annular and surround the mixing tube 104. According to an embodiment, the bluff body members hold at least a portion of the combustion reaction 114.

According to an embodiment, the mixing tube 104 is configured to recirculate flue gas into the mixing volume. According to an embodiment, the mixing tube 104 includes one or more flue gas apertures configured to admit the flue gas into the mixing volume. According to an embodiment, the mixing tube 104 is configured to mix the flue gas with the fuel 112 and the oxidant 110 to generate a mixture 115 of the fuel 112 and the oxidant 110.

In the description below of succeeding figures, many embodiments of combustions systems are described in relation to perforated flame holders. However, combustion systems as described herein can include flame holders other than perforated flame holders. For example, according to various embodiments, bluff body flame holders can be used in place of perforated flame holders. In these cases, bluff body flame holders may include multiple bluff body tiles separated from each other by gaps.

Figure 2:
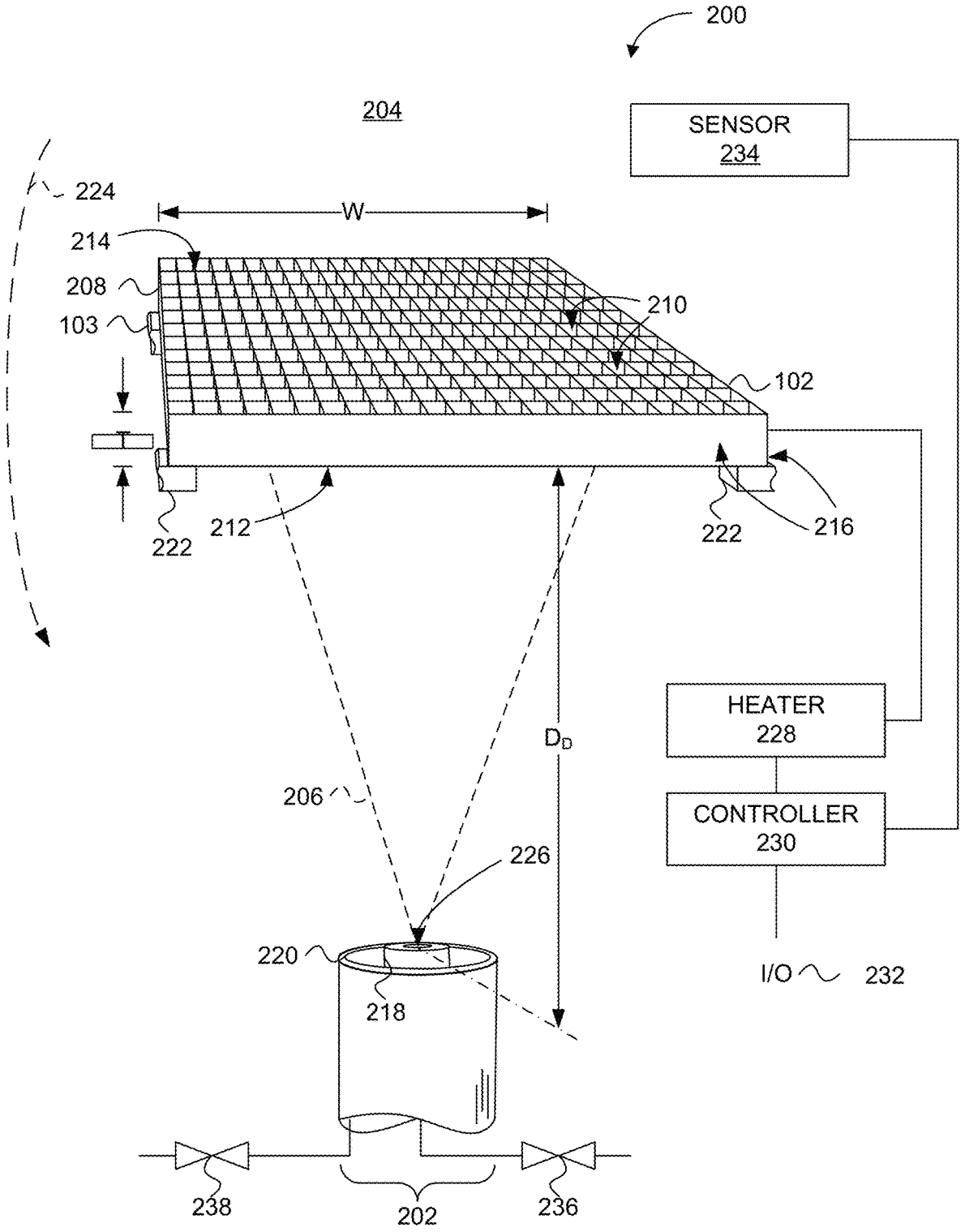
FIG. 2 is a diagram of a combustion system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of burner systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen (02) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
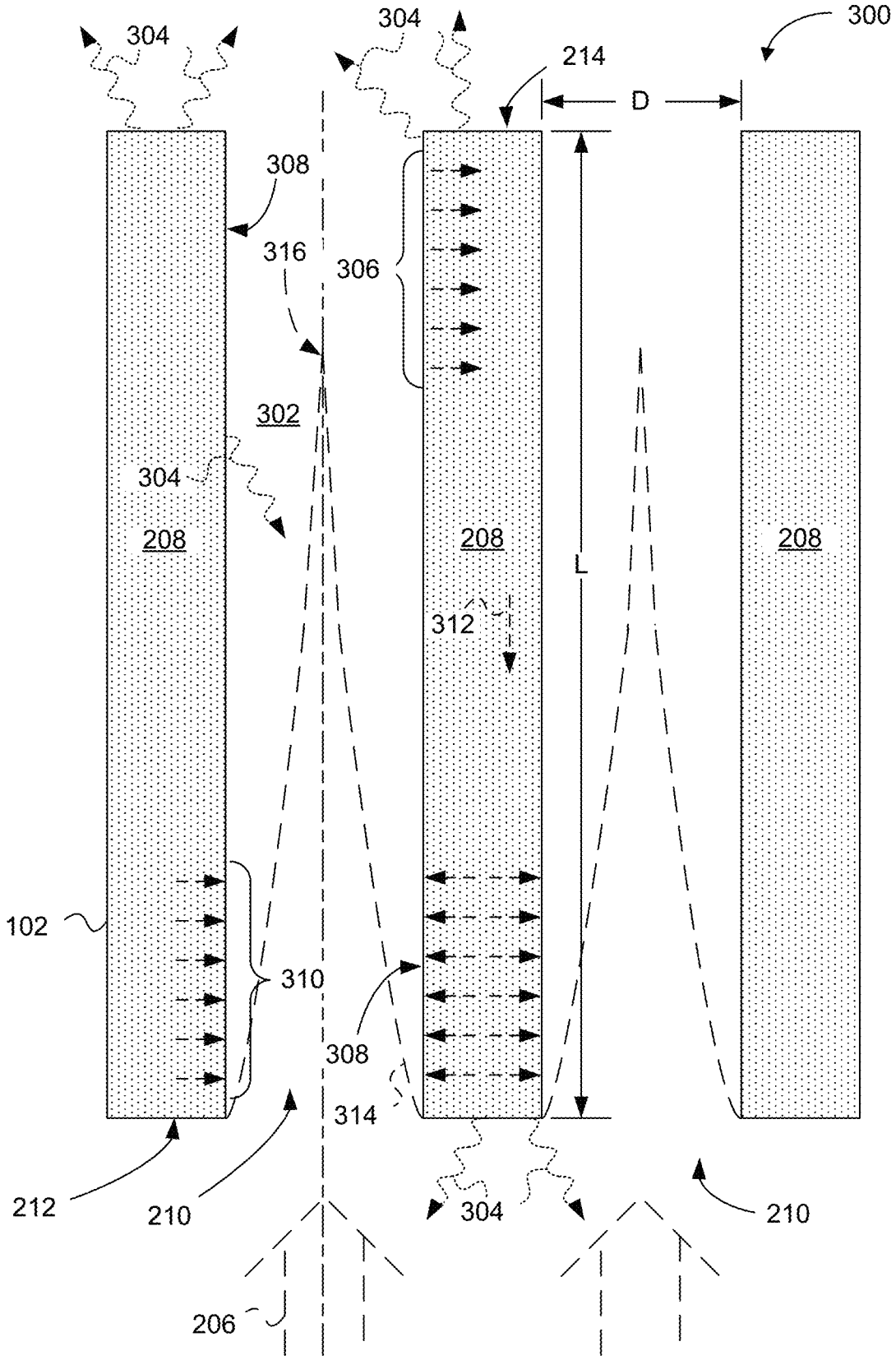
FIG. 3 is a cross-sectional diagram of a perforated flame holder, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and the output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and a fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to the heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to the walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within the thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and the output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation 210. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for the thermal boundary layers 314 to form adjacent to the perforation walls 308 in a reaction fluid flowing through the perforations 210 to converge at the merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include the fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and the oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source 220 can be configured to entrain the fuel and the fuel and the oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The perforated flame holder support structure 222 can be configured to support the perforated flame holder 102 from a floor or wall (not shown) of the combustion volume 204, for example. In another embodiment, the perforated flame holder support structure 222 supports the perforated flame holder 102 from the fuel and oxidant source 202. Alternatively, the perforated flame holder support structure 222 can suspend the perforated flame holder 102 from an overhead structure (such as a flue, in the case of an up-fired system). The perforated flame holder support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas recirculation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example, the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including the perforated flame holder body 208 and the perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, South Carolina.

The perforations 210 can be parallel to one another and normal to the input and the output faces 212, 214. In another embodiment, the perforations 210 can be parallel to one another and formed at an angle relative to the input and the output faces 212, 214. In another embodiment, the perforations 210 can be non-parallel to one another. In another embodiment, the perforations 210 can be non-parallel to one another and non-intersecting. In another embodiment, the perforations 210 can be intersecting. The perforated flame holder body 208 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together.

The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g., Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which the fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e., an equivalence ratio of ~0.87. Use of even leaner mixtures is possible, but may result in elevated levels of $O_2$. Moreover, the inventors believe the perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
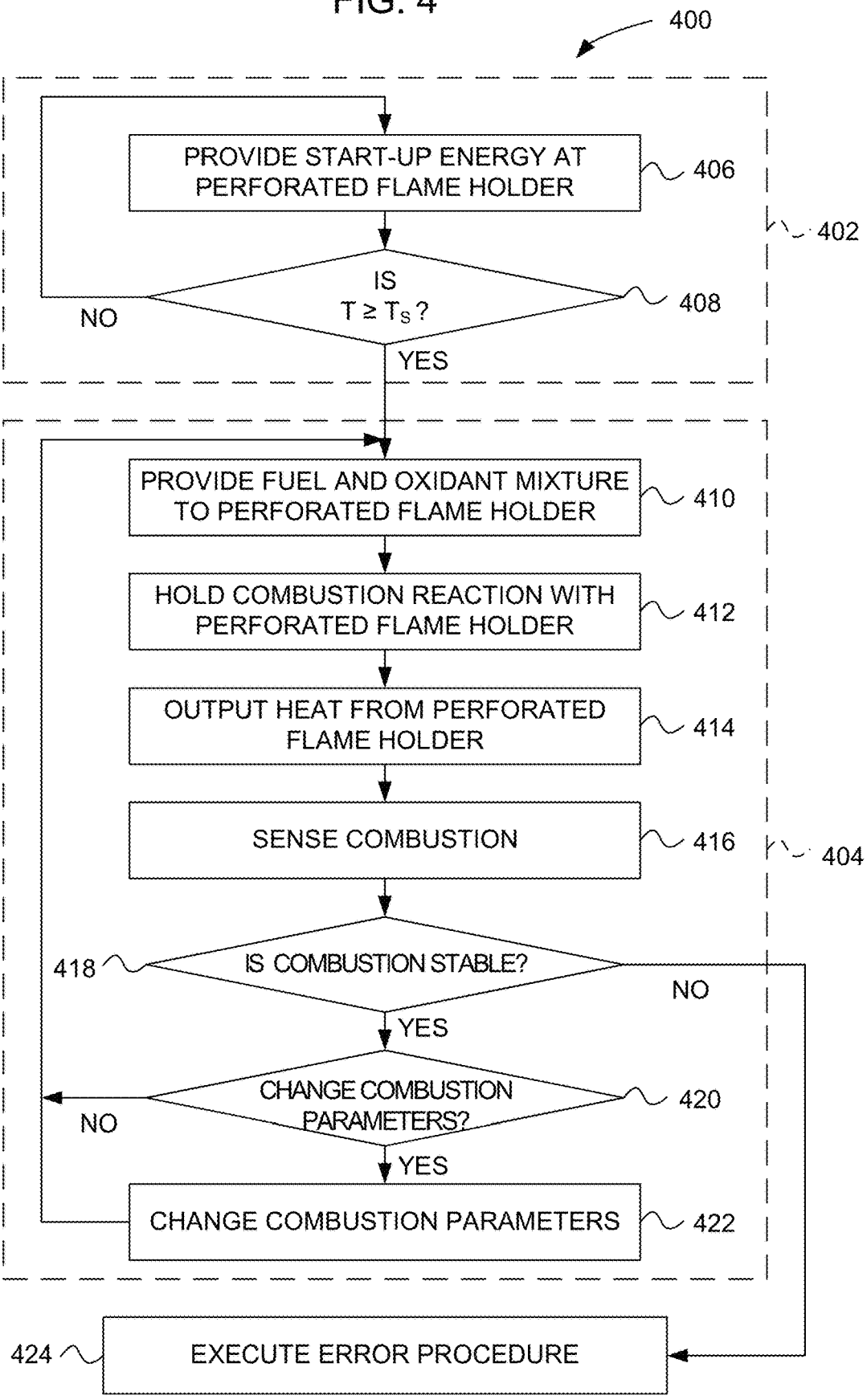
FIG. 4 is a flow diagram for a process for operating a combustion system including a perforated flame holder, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In decision step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from decision step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in decision step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and the oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture 206 that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture 206 flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater 228 can be configured to heat up the perforated flame holder 102 to an operating temperature. The electrical resistance heater 228 can further include a power supply and a switch operable, under control of the controller 230, to selectively couple the power supply to the electrical resistance heater 228.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g., microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and the fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the controller 230. The sensor 234 can include a heat sensor configured to detect infrared radiation or a temperature of the perforated flame holder 102. The control circuit 230 can be configured to control the heater 228 responsive to input from the sensor 234. Optionally, a fuel control valve 236 can be operatively coupled to the controller 230 and configured to control a flow of the fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of the fuel from a fuel source to the fuel and oxidant source 202. The controller 230 can be configured to control the fuel control valve 236 responsive to input from the combustion sensor 234. The controller 230 can be configured to control the fuel control valve 236 and/or the oxidant blower or damper 238 to control a preheat flame type of heater 228 to heat the perforated flame holder 102 to an operating temperature. The controller 230 can similarly control the fuel control valve 236 and/or the oxidant blower or damper 238 to change the fuel and oxidant mixture 206 flow responsive to a heat demand change received as data via the data interface 232.

Figure 5A:
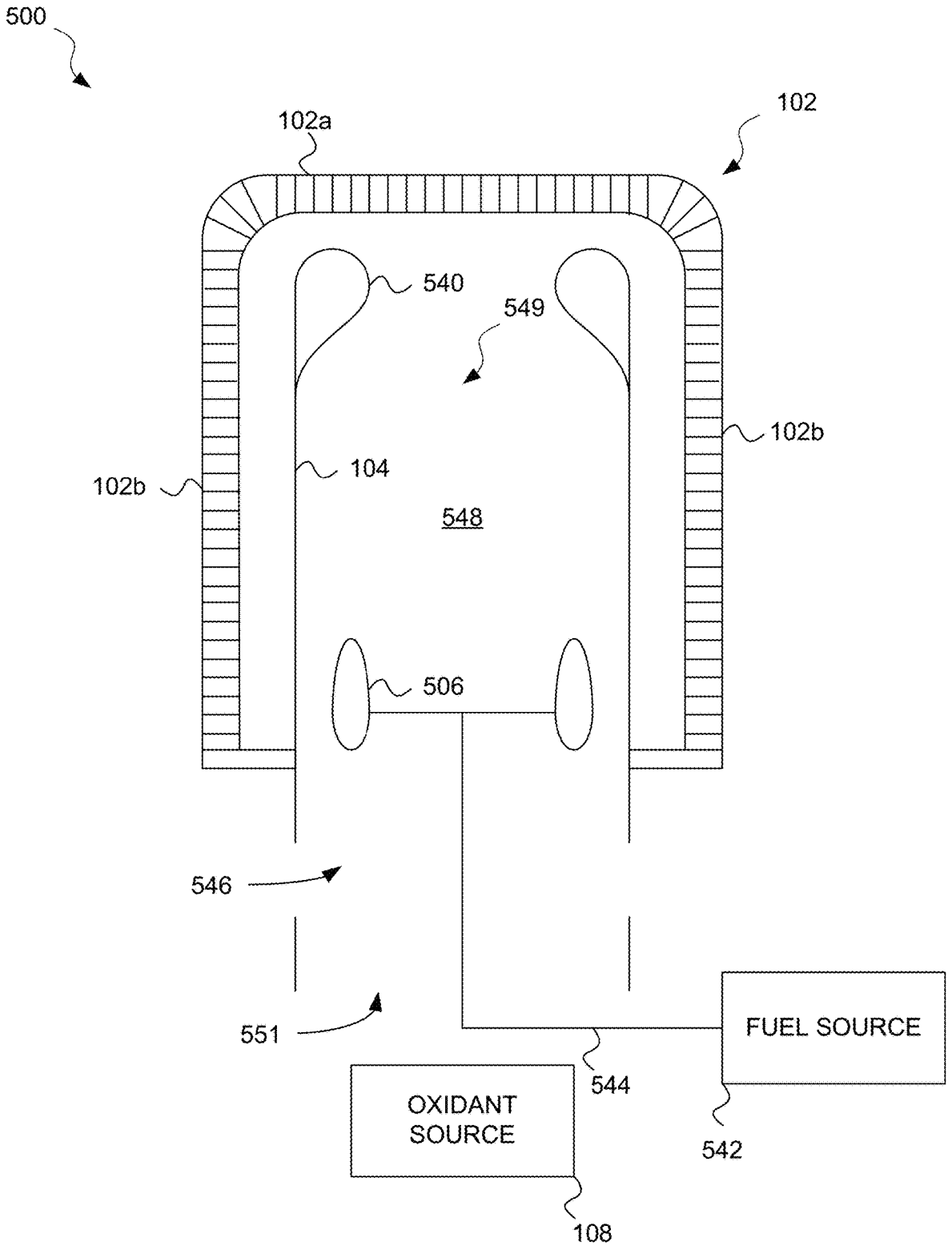
FIG. 5A is a diagram of a combustion system including a mixing tube and a perforated flame holder, according to an embodiment.

FIG. 5A is a diagram of a combustion system 500, according to an embodiment. The combustion system 500 includes a perforated flame holder 102, a mixing tube 104, a fuel distributor 506, an oxidant source 108, and a fuel source 542.

According to an embodiment, the mixing tube 104 defines a mixing volume 548 internal to the mixing tube 104. The mixing tube 104 includes an input opening 551 and an output opening 549. The mixing tube 104 also includes flue gas recirculation apertures 546.

According to an embodiment, the combustion system 500 includes flow diverters 540 positioned at the output opening 549 of the mixing tube 104. The flow diverters 540 include a curvature selected to cause the fuel and oxidant mixture 206 from the mixing tube 104 to follow the surface of the flow diverters 540.

According to an embodiment, the perforated flame holder 102 includes a central portion 102*a* positioned directly above the output opening 549 of the mixing tube 104. The perforated flame holder 102 also includes a peripheral portion 102*b* positioned peripherally to the mixing tube 104. According to an embodiment, the peripheral portion 102*b* of the perforated flame holder 102 has a cylindrical shape and laterally surrounds a portion of the mixing tube 104. An input surface of perforated flame holder 102 corresponds to an upstream surface of the perforated flame holder 102. An output surface of the perforated flame holder 102 corresponds to an upstream surface of the perforated flame holder 102.

According to an embodiment, the fuel distributor 506 includes one or more fuel nozzles configured to output the fuel 112 into the mixing volume 548 within the mixing tube 104. According to an embodiment, the fuel distributor 506 is an annular fuel distributor 506 including a plurality of apertures each configured to output the fuel 112 into the mixing volume 548. According to an embodiment, the fuel distributor 506 has a shape configured to create vortices in the oxidant 110 and the fuel 112.

According to an embodiment, the fuel source 542 is coupled to the fuel distributors 506 by a fuel line 544.

Figure 5B:
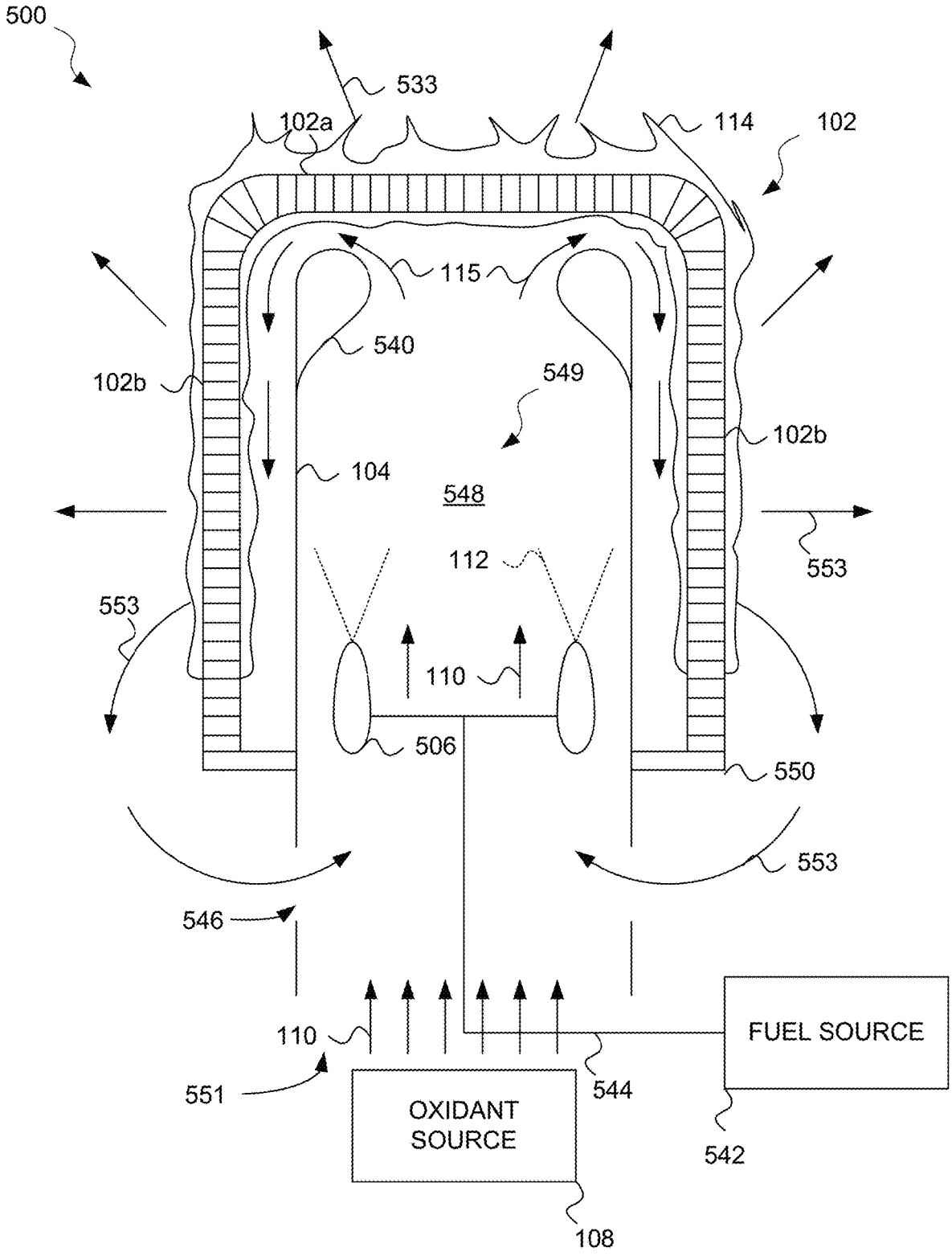
FIG. 5B is a diagram of the combustion system of FIG. 5A in a standard operating state, according to an embodiment.

FIG. 5B is a diagram of the combustion system 500 of FIG. 5A in a standard operating condition, according to an embodiment. In the standard operating condition, the oxidant source 108 outputs the oxidant 110 into the mixing tube 104. The fuel source 542 supplies the fuel 112 to the fuel distributors 506 via the fuel line 544. The fuel distributor 506 outputs the fuel 112 into the mixing volume 548 of the mixing tube 104. The fuel 112 and the oxidant 110 mix within the mixing volume 548. A mixture 115 of the fuel 112 and the oxidant 110 is output from the mixing tube 104. The perforated flame holder 102 receives the mixture 115 of the fuel 112 and the oxidant 110 and sustains a combustion reaction 114 of the mixture 115 of the fuel 112 and the oxidant 110.

According to an embodiment, as the oxidant 110 flows around the fuel distributor 506, the shape of the fuel distributor 506 causes vortices to form in the oxidant 110. The vortices in the oxidant 110 cause vortices in the fuel 112. As the fuel 112 and the oxidant 110 flows through the mixing volume 548 toward the output opening 549 of the mixing tube 104, the vortices in the fuel 112 and the oxidant 110 cause the fuel 112 and the oxidant 110 to become well mixed. The mixing of the fuel 112 and oxidant 110 enables the perforated flame holder 102 to support a combustion reaction 114 of the mixture 115 of the fuel 112 and the oxidant 110. The enhanced mixing caused by the vortices enables the mixing tube 104 to have a shorter length than might otherwise be possible in the absence of the vortex motion.

According to an embodiment, the flow diverters 540 are shaped to effectively reduce the size of the output opening 549 of the mixing tube 104. As the mixture 115 of the fuel 112 and the oxidant 110 exits the mixing volume 548 via the output opening 549 of the mixing tube 104, a portion of the mixture 115 of the fuel 112 and the oxidant 110 impinges on the surface of the flow diverters 540. The flow diverters 540 have a bluff body shape that causes the mixture 115 of the fuel 112 and the oxidant 110 to flow along the surface of the flow diverters 540. This portion of the mixture 115 of the fuel 112 and the oxidant 110 flows around the body of the flow diverter 540 and is diverted to the peripheral portion 102*b* of the perforated flame holder 102. A portion of the mixture 115 of the fuel 112 and the oxidant 110 will flow downward along an outer wall of the mixing tube 104 in a direction that is antiparallel to the primary direction of flow of the fuel 112 and the oxidant 110 within the mixing volume 548. In this way, the mixture 115 flows to all parts of the peripheral portion 102*b* of the perforated flame holder 102. The peripheral portion 102*b* of the perforated flame holder 102 sustains a combustion reaction 114 of the mixture 115 of the fuel 112 and the oxidant 110.

According to an embodiment, a portion of the mixture 115 flows substantially uninterrupted in an upward direction toward the central portion 102*a* of the perforated flame holder 102. The central portion 102*a* of the perforated flame holder 102 receives a portion of the mixture 115 of the fuel 112 and the oxidant 110 directly above the output opening 549 of the mixing tube 104. The central portion 102*a* of the perforated flame holder 102 sustains a combustion reaction 114 of the mixture 115 of the fuel 112 and the oxidant 110.

According to an embodiment, flue gas 533 exits from the output surface of the perforated flame holder 102. The flue gas 533 can include combustible gases from the combustion reaction 114. The flue gas 533 can also include uncombusted or incompletely combusted fuel 112 and oxidant 110. A portion of the flue gas 533 is recirculated into the mixing tube 104 via the flue gas recirculation apertures 546 in the lower end of the mixing tube 104. The flue gas 533 flows upward through the mixing volume 548 and mixes with the fuel 112 and the oxidant 110. The mixture 115 of the fuel 112, the oxidant 110, and the recirculated flue gas 533 is received at the perforated flame holder 102. The uncombusted portions of the flue gas 533 are combusted in the combustion reaction 114. In this way, the combustion system 500 more completely combusts the fuel 112 and the oxidant 110. This results in a more efficient and cleaner burning combustion system 500.

According to an embodiment, the perforated flame holder 102 is substantially in the shaped of a bell jar. The bell jar shaped perforated flame holder 102 rests on a support structure 550 coupled to the mixing tube 104. The perforated flame holder 102 can be installed in the combustion system 500 by placing the perforated flame holder 102 onto the support structure 550. When installed in the combustion system 500, the perforated flame holder 102 is placed over and around the mixing tube 104. The perforated flame holder 102 can be removed from the combustion system 500 by lifting the perforated flame holder 102 off of the support structure 550.

According to an embodiment, the mixing tube 104 is shaped to convey the fuel 112 and the oxidant 110 at a bulk velocity higher than a flame propagation speed. The mixing tube 104 is sized for a residence time shorter than a chemical ignition delay time of the fuel 112 and the oxidant 110 traversing the mixing volume 548.

Though FIGS. 5A and 5B illustrate a combustion system 500 that includes a perforated flame holder 102, according to an embodiment the combustion system 500 can include a flame holder 102 other than a perforated flame holder. For example, the combustion system 500 can include a bluff body flame holder including one or more bluff bodies. The bluff bodies can include solid bluff body tiles separated from each other by gaps. The bluff body tiles can hold or support a combustion reaction 114 of the fuel 112 and oxidant 110. The flame holder 102 can include one or more central bluff bodies 102*a* and one or more peripheral bluff bodies 102*b*.

Figure 6A:
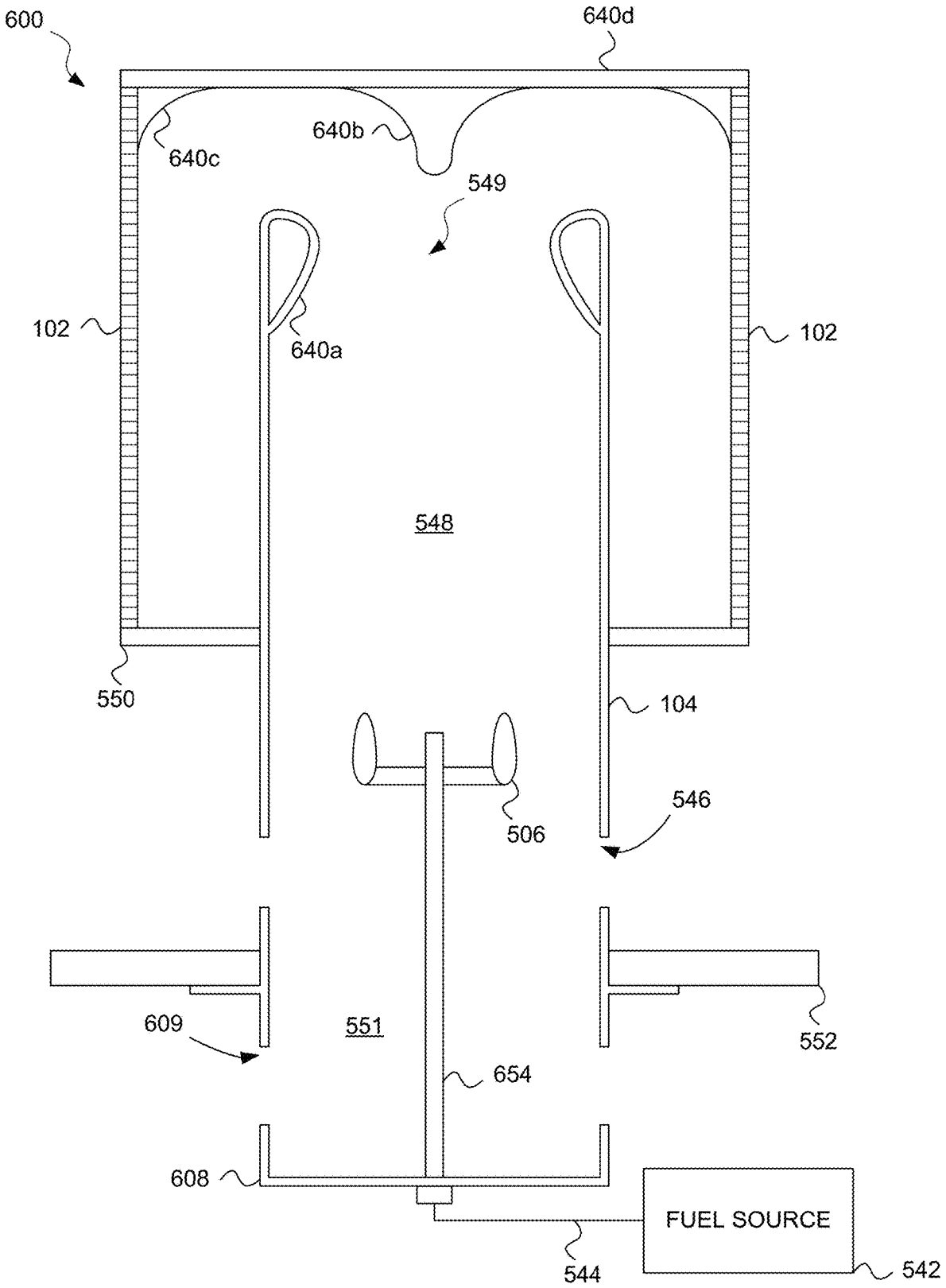
FIG. 6A is a diagram of a combustion system including a mixing tube and a perforated flame holder, according to an embodiment.

FIG. 6A is a diagram of a combustion system 600, according to an embodiment. The combustion system 600 includes a perforated flame holder 102, a mixing tube 104, a fuel distributor 506, an oxidant source 608, and a fuel source 542.

According to an embodiment, the mixing tube 104, the fuel distributor 506, and the fuel source 542, are substantially similar in many ways to their counterparts in the combustion system 500 of FIG. 5A and FIG. 5B.

According to an embodiment, the perforated flame holder 102 is a cylindrical perforated flame holder 102. The cylindrical perforated flame holder 102 is supported on the support structure 550 coupled to the mixing tube 104. The cylindrical perforated flame holder 102 surrounds a portion of the mixing tube 104. The perforated flame holder 102 does not include a central portion directly above the output opening 549 of the mixing tube 104, according to an embodiment.

According to an embodiment, the flow diverter 640 includes a bluff body portion 640*a* coupled to the mixing tube 104 near the output opening 549 of the mixing tube 104. The flow diverter 640 includes a flat plate 640*d* positioned on top of the perforated flame holder 102. A portion of the flat plate 640*d* is positioned directly above the mixing tube 104. The flow diverter 640 includes a central diverting protrusion 640*b* coupled to a bottom surface of the flat plate 640*d* and protruding downward toward the mixing tube 104. The central diverting protrusion 640*b* is aligned axially with the mixing tube 104. The flow diverter 640 also includes rounded corner diverters 640*c* positioned at the corner where the perforated flame holder 102 meets the flat plate 640*d*. The flow diverter 640 has the effect of diverting a mixture 115 of the fuel 112 and the oxidant 110 toward the perforated flame holder 102.

According to an embodiment, the oxidant source 608 is a barrel register coupled to the bottom of the furnace floor 552. The barrel register includes apertures 609 configured to introduce the oxidant 110 into the mixing tube 104.

According to an embodiment, the fuel distributor 506 is coupled to a fuel riser 654. The fuel riser 654 is configured to receive the fuel 112 from the fuel source 542 and to pass the fuel 112 to the fuel distributor 506.

Figure 6B:
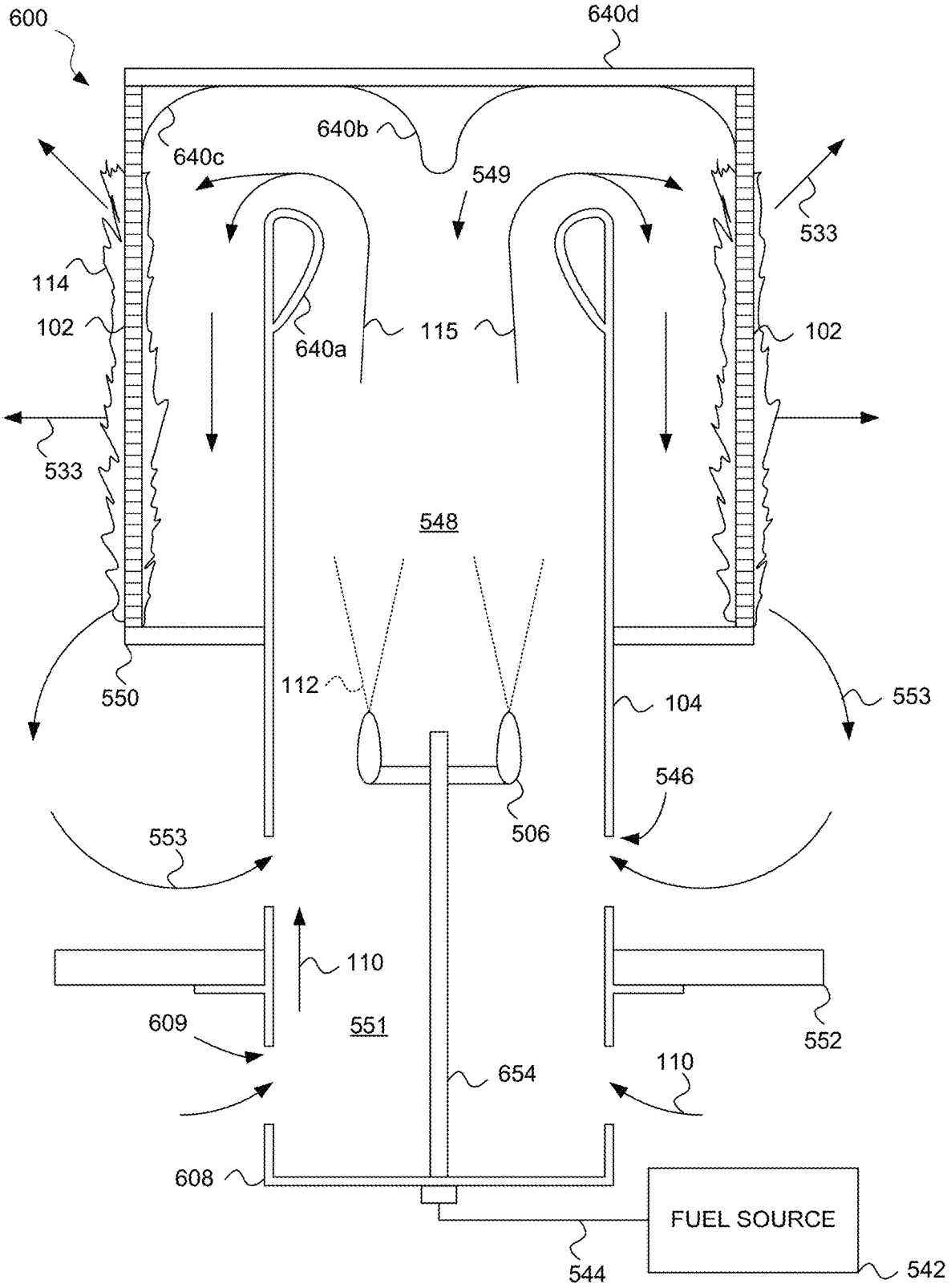
FIG. 6B is a diagram of the combustion system of FIG. 6A in a standard operating state, according to an embodiment.

FIG. 6B is a diagram of the combustion system 600 of FIG. 6A in a standard operating condition, according to an embodiment. In the standard operating condition, the oxidant source 608 outputs the oxidant 110 into the mixing tube 104. The fuel source 542 supplies the fuel 112 to the fuel distributors 506 via the fuel line 544 and the fuel riser 654. The fuel distributor 506 outputs the fuel 112 into the mixing volume 548 of the mixing tube 104. The fuel 112 and the oxidant 110 mix within the mixing volume 548. A mixture 115 of the fuel 112 and the oxidant 110 is output from the mixing tube 104. The perforated flame holder 102 receives the mixture 115 of the fuel 112 and the oxidant 110 and sustains a combustion reaction 114 of the mixture 115 of the fuel 112 and the oxidant 110.

According to an embodiment, as the oxidant 110 flows around the fuel distributor 506, the shape of the fuel distributor 506 causes vortices to form in the oxidant 110. The vortices in the oxidant 110 cause vortices in the fuel 112. As the fuel 112 and the oxidant 110 flow through the mixing volume 548 toward the output opening 549 of the mixing tube 104, the vortices in the fuel 112 and the oxidant 110 cause the fuel 112 and the oxidant 110 to become well mixed. The mixing of the fuel 112 and the oxidant 110 enables the perforated flame holder 102 to support a combustion reaction 114 of the mixture 115 of the fuel 112 and the oxidant 110. The enhanced mixing caused by the vortices enables the mixing tube 104 to have a shorter length than might otherwise be possible in the absence of the vortex motion.

According to an embodiment, the bluff body flow diverters 640*a* are shaped to effectively reduce the size of the output opening 549 of the mixing tube 104. As the mixture 115 of the fuel 112 and the oxidant 110 exits the mixing volume 548 via the output opening 549 of the mixing tube 104, a portion of the mixture 115 of the fuel 112 and the oxidant 110 impinges on the surface of the bluff body flow diverters 640*a*. The flow diverters 640*a* of the bluff body shape causes the mixture 115 of the fuel 112 and the oxidant 110 to flow along the surface of the flow diverter 640. This portion of the mixture 115 of the fuel 112 and the oxidant 110 flows around the body of the flow diverter 640*a* and is diverted to the perforated flame holder 102. A portion of the mixture 115 will impinge on the central diverting protrusion 640*b*. The central diverting protrusion 640*b* forces the mixture 115 laterally outward toward the rounded corner diverters 640*c*. The rounded corner diverters 640*c* divert the mixture 115 downward toward the perforated flame holder 102. The mixture 115 will flow downward along an outer wall of the mixing tube 104 in a direction that is antiparallel to the primary direction of flow of the fuel 112 and the oxidant 110 within the mixing volume 548. In this way, the mixture 115 flows to all parts of the perforated flame holder 102. The perforated flame holder 102 sustains a combustion reaction 114 of the mixture 115 of the fuel 112 and the oxidant 110.

According to an embodiment, the flue gas 533 exits from the output surface of the perforated flame holder 102. The flue gas 533 can include combustible gases from the combustion reaction 114. The flue gas 533 can also include uncombusted or incompletely combusted fuel 112 and oxidant 110. A portion of the flue gas 533 is recirculated into the mixing tube 104 via the flue gas recirculation apertures 546 in the lower end of the mixing tube 104. The flue gas 533 flows upward through the mixing volume 548 and mixes with the fuel 112 and the oxidant 110. The mixture 115 of the fuel 112, the oxidant 110, and the recirculated flue gas 533 is received at the perforated flame holder 102. The reaction 104. In this way, the combustion system 600 more completely combusts the fuel 112 and the oxidant 110. This results in a more efficient and cleaner burning combustion system 600.

Though FIGS. 6A and 6B illustrate a combustion system 600 that includes a perforated flame holder 102, according to an embodiment the combustion system 600 can include a flame holder 102 other than a perforated flame holder. For example, the combustion system 600 can include a bluff body flame holder including one or more bluff bodies. The bluff bodies can include solid bluff body tiles separated from each other by gaps. The bluff body tiles can hold or support a combustion reaction 114 of the fuel 112 and oxidant 110.

Figure 7A:
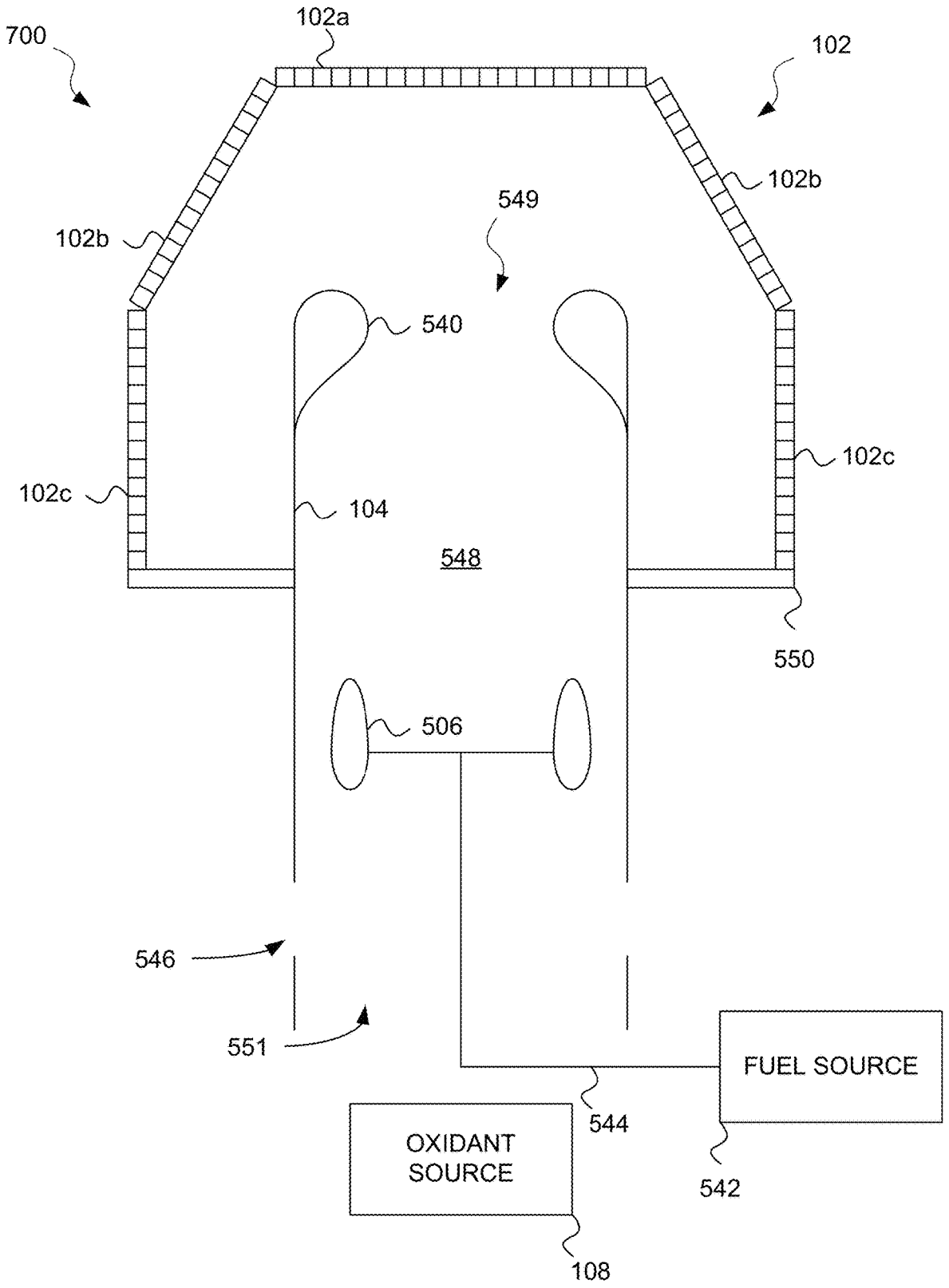
FIG. 7A is a diagram of a combustion system including a mixing tube and a perforated flame holder, according to an embodiment.

FIG. 7A is a diagram of a combustion system 700, according to an embodiment. The combustion system 700 includes a perforated flame holder 102, a mixing tube 104, a fuel distributor 506, an oxidant source 108, and a fuel source 542. The combustion system 700 is similar in many ways to the combustion system 500 of FIG. 5A and FIG. 5B, according to an embodiment.

According to an embodiment, the mixing tube 104 defines a mixing volume 548 interior to the mixing tube 104. The mixing tube 104 includes an input opening 551 and an output opening 549. The mixing tube 104 also includes flue gas recirculation apertures 546.

According to an embodiment, the combustion system 700 includes flow diverters 540 positioned at the output opening 549 of the mixing tube 104. The flow diverters 540 body profile the curvature selected to cause the fuel and oxidant mixture 115 from the mixing tube 104 to follow the surface of the flow diverters 540.

The combustion system 700 includes a perforated flame holder 102 including many facets or tiles 102*a*-102*c*. The perforated flame holder 102 includes a central facet 102*a* positioned directly above the output opening 549 of the mixing tube 104. The perforated flame holder 102 also includes peripheral facets 102*b* and 102*c* positioned peripherally to the mixing tube 104.

According to an embodiment, the fuel distributor 506 includes one or more fuel nozzles configured to output the fuel 112 into the mixing volume 548 within the mixing tube 104. According to an embodiment, the fuel distributor 506 is an annular fuel distributor including a plurality of apertures each configured to output the fuel 112 into the mixing volume 548. According to an embodiment, the fuel distributor 506 has a shape configured to create vortices in the oxidant 110 and the fuel 112.

According to an embodiment, the fuel source 542 is coupled to the fuel distributors 506 by a fuel line 544.

Figure 7B:
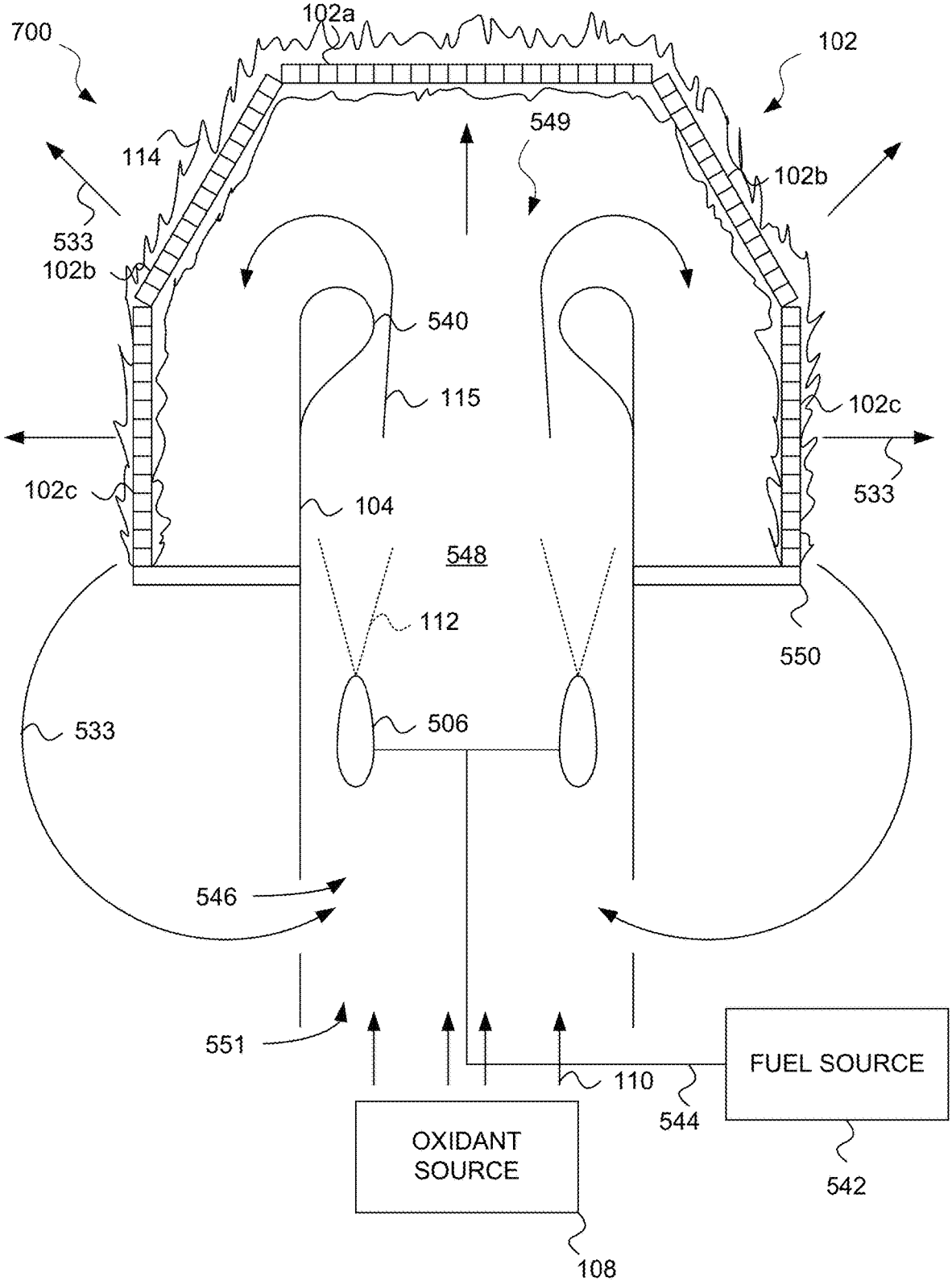
FIG. 7B is a diagram of the combustion system of FIG. 7A in a standard operating state, according to an embodiment.

FIG. 7B is a diagram of the combustion system 700 of FIG. 7A in a standard operating condition, according to an embodiment. In the standard operating condition, the oxidant source 108 outputs the oxidant 110 into the mixing tube 104. The fuel source 542 supplies the fuel 112 to the fuel distributors 506 via the fuel line 544. The fuel distributor 506 outputs the fuel 112 into the mixing volume 548 of the mixing tube 104. The fuel 112 and the oxidant 110 mix within the mixing volume 548. A mixture 115 of the fuel 112 and the oxidant 110 is output from the mixing tube 104. The perforated flame holder 102 receives the mixture 115 of the fuel 112 and the oxidant 110 and sustains a combustion reaction 114 of the mixture 115 of the fuel 112 and the oxidant 110.

According to an embodiment, as the oxidant 110 flows around the fuel distributors 506 the shape of the fuel distributors 506 cause vortices to form in the oxidant 110. The vortices in the oxidant 110 cause vortices in the fuel 112. As the fuel 112 and the oxidant 110 flows through the mixing volume 548 toward the output end 549 of the mixing tube 104, the vortices in the fuel 112 and the oxidant 110 cause the fuel 112 and the oxidant 110 to become well mixed. The mixing of the fuel 112 and the oxidant 110 enables the perforated flame holder 102 to support a combustion reaction 114 of the mixture 115 of the fuel 112 and the oxidant 110. The enhanced mixing caused by the vortices enables the mixing tube 104 to have a shorter length than might otherwise be possible in the absence of the vortex motion.

According to an embodiment, the flow diverters 540 are shaped to effectively reduce the size of the output opening 549 of the mixing tube 104. As the mixture 115 of the fuel 112 and the oxidant 110 exits the mixing volume 548 via the output opening 549 of the mixing tube 104, a portion of the mixture 115 of the fuel 112 and the oxidant 110 impinges on the surface of the flow diverters 540. The flow diverters 540 have the bluff body shape that causes the mixture 115 of the fuel 112 and the oxidant 110 to flow along the surface of the flow diverter 540. This portion of the mixture 115 of the fuel 112 and the oxidant 110 flows around the body of the flow diverter 540 and is diverted to the peripheral portion 102*b* of the perforated flame holder 102. A portion of the mixture 115 of the fuel 112 and the oxidant 110 will flow downward along an outer wall of the mixing tube 104 in a direction that is antiparallel to the primary direction of flow of the fuel 112 and the oxidant 110 within the mixing volume 548. In this way, the mixture 115 flows to all parts of the peripheral portions 102*b*, 102*c* of the perforated flame holder 102. The peripheral portions 102*b*, 102*c* of the perforated flame holder 102 sustain a combustion reaction 114 of the mixture 115 of the fuel 112 and the oxidant 110.

According to an embodiment, a portion of the mixture 115 flows uninterrupted in an upward direction toward the central portion 102*a* of the perforated flame holder 102. The central portion 102*a* of the perforated flame holder 102 receives a portion of the mixture 115 of the fuel 112 and the oxidant 110 directly above the output opening 549 of the mixing tube 104. The central portion 102*a* of the perforated flame holder 102 sustains a combustion reaction 114 of the mixture 115 of the fuel 112 and the oxidant 110.

According to an embodiment, the flue gas 533 exits from the output surface of the perforated flame holder 102. The flue gas 533 can include combustible gases from the combustion reaction 114. The flue gas 533 can also include uncombusted or incompletely combusted fuel 112 and oxidant 110. A portion of the flue gas 533 is recirculated into the mixing tube 104 via the flue gas recirculation apertures 546 in the lower end of the mixing tube 104. The flue gas 533 flows upward through the mixing volume 548 and mixes with the fuel 112 and the oxidant 110. The mixture 115 of the fuel 112, the oxidant 110, and the recirculated flue gas 533 is received at the perforated flame holder 102. The reaction 114. In this way, the combustion system 700 more completely combusts the fuel 112 and the oxidant 110. This results in a more efficient and cleaner burning combustion system 700.

According to an embodiment, the perforated flame holder 102 is substantially in the shape of a bell jar. The bell jar shaped perforated flame holder 102 rests on a support structure 550 coupled to the mixing tube 104. The perforated flame holder 102 can be installed in the combustion system 700 by placing the perforated flame holder 102 onto the support structure 550. When installed in the combustion system 700, the perforated flame holder 102 is placed over and around the mixing tube 104. The perforated flame holder 102 can be removed from the combustion system 700 by lifting the perforated flame holder 102 off of the support structure 550.

According to an embodiment, the mixing tube 104 is shaped to convey the fuel 112 and the oxidant 110 at a bulk velocity higher than a flame propagation speed. The mixing tube 104 is sized for a residence time shorter than a chemical ignition delay time of the fuel 112 and the oxidant 110 traversing the mixing volume 548.

Figure 7C:
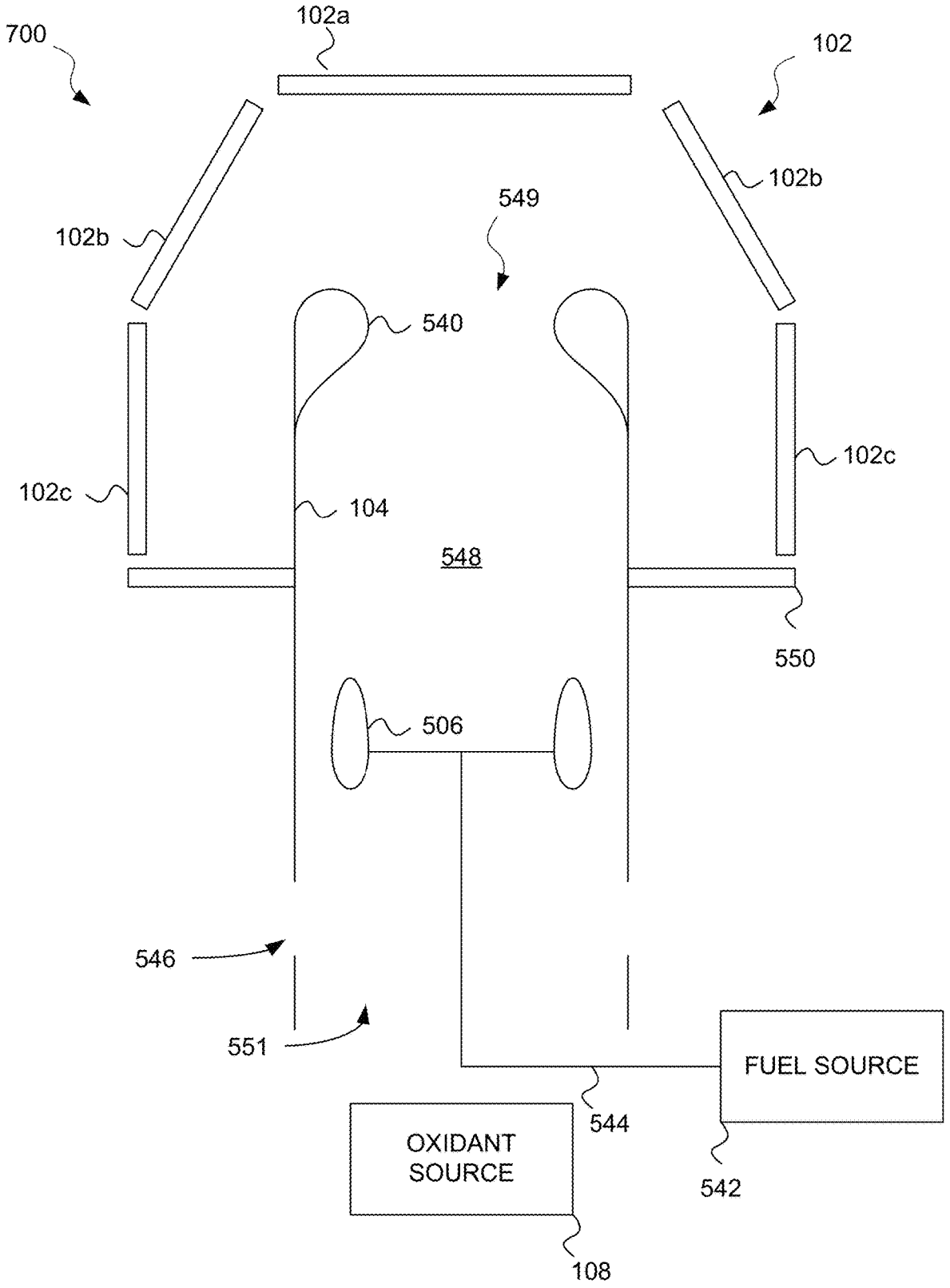
FIG. 7C is a diagram of a combustion system including a mixing tube and a flame holder, according to an embodiment.

FIG. 7C illustrates an embodiment of a combustion system 700 in which the flame holder 102 is a bluff body flame holder. The bluff body flame holder 102 includes a plurality of bluff body tiles 102*a*-102*c* separated from each other by gaps. The bluff body tiles 102*a*-102*c* can collectively hold a combustion reaction 114 of the fuel 112 and oxidant 110.

Figure 8A:
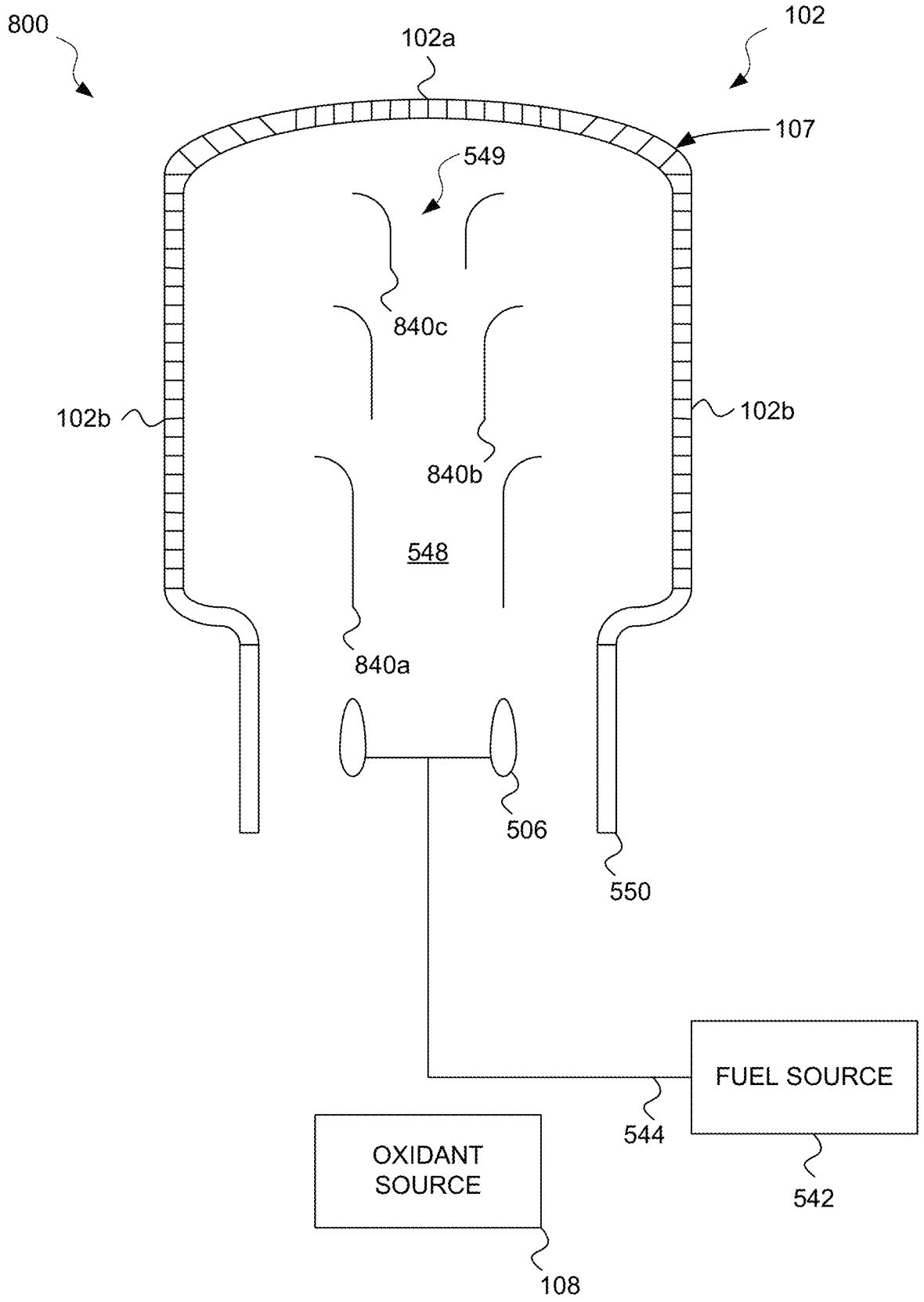
FIG. 8A is a diagram of a combustion system including a mixing tube and a perforated flame holder, according to an embodiment.

FIG. 8A is a diagram of a combustion system 800, according to an embodiment. The combustion system 800 includes a perforated flame holder 102, a plurality of flow diverters 840*a-c*, a fuel distributor 506, an oxidant source 108, and a fuel source 542.

According to an embodiment, the flow diverters 840*a*-840*c* each divert a portion of the mixture 115 of the fuel 112 and the oxidant 110 from the mixing volume 548 toward respective portions of the perforated flame holder 102. The flow diverters 840*a*-840*c* define a mixing tube 104 of variable diameter. The diameter of the mixing tube 104 between the flow diverters 840*a* is larger than the diameter of the mixing tube 104 between the flow diverters 840*b*. The diameter of the mixing tube 104 between the flow diverters 840*b* is larger than the diameter of the mixing tube 104 between the flow diverters 840*c*.

According to an embodiment, the perforated flame holder 102 includes a central portion 102*a* positioned directly above the output opening 549 of the mixing tube 104. The perforated flame holder 102 also includes a peripheral portion 102*b* positioned peripherally to the mixing tube 104. According to an embodiment, the peripheral portion 102*b* of the perforated flame holder 102 has a cylindrical shape and laterally surrounds a portion of the mixing tube 104. An input surface of perforated flame holder 102 corresponds to an upstream surface of the perforated flame holder 102. An output surface of the perforated flame holder 102 corresponds to an upstream surface of the perforated flame holder 102.

According to an embodiment, the fuel distributor 506 includes one or more fuel nozzles configured to output the fuel 112 into the mixing volume 548 within the mixing tube 104. According to an embodiment, the fuel distributor 506 is an annular fuel distributor including a plurality of apertures each configured to output the fuel 112 into the mixing volume 548. According to an embodiment, the fuel distributor 506 has a shape configured to create vortices in the oxidant 110 and the fuel 112.

According to an embodiment, the fuel source 542 is coupled to the fuel distributors 506 by a fuel line 544.

Figure 8B:
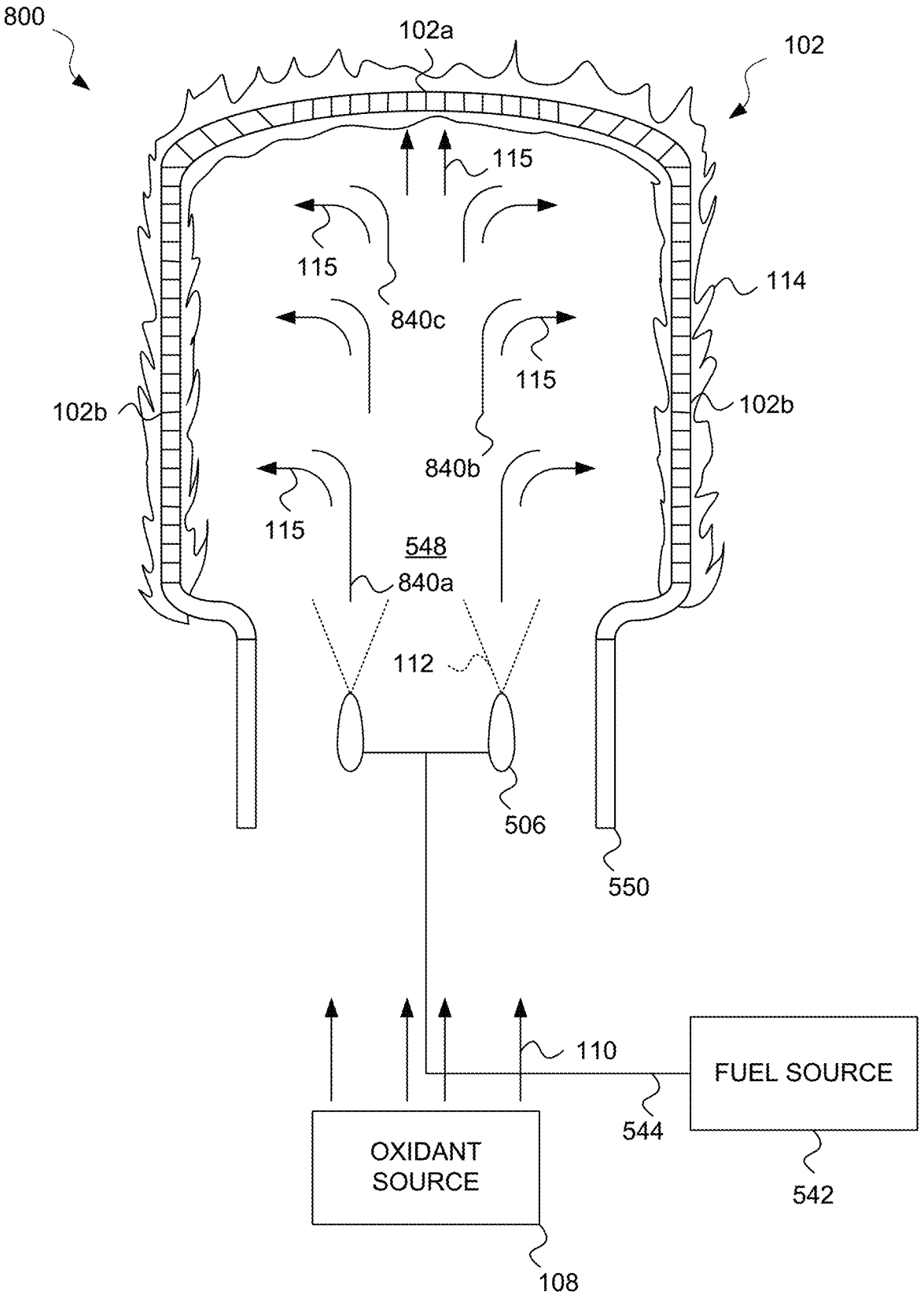
FIG. 8B is a diagram of the combustion system of FIG. 8A in a standard operating state, according to an embodiment.

FIG. 8B is a diagram of the combustion system 800 of FIG. 8A in a standard operating condition, according to an embodiment. In the standard operating condition, the oxidant source 108 outputs the oxidant 110 into the mixing volume 548. The fuel source 542 supplies the fuel 112 to the fuel distributors 506 via the fuel line 544. The fuel distributor 506 outputs the fuel 112 into the mixing volume 548 of the mixing tube 104. The fuel 112 and the oxidant 110 mix within the mixing volume 548. Various portions of the mixture 115 of the fuel 112 and the oxidant 110 are diverted to various portions of the perforated flame holder 102. The perforated flame holder 102 receives the mixture 115 of the fuel 112 and the oxidant 110 and sustains a combustion reaction 114 of the mixture 115 of the fuel 112 and the oxidant 110.

According to an embodiment, a first portion of the mixture 115 is diverted by the flow diverter 840*a* toward a lowest portion of the peripheral portion 102*b* of the perforated flame holder 102. According to an embodiment, a portion of the mixture 115 is diverted by the flow diverter 840*b* toward a middle portion of the peripheral portion 102*b* of the perforated flame holder 102. According to an embodiment, a portion of the mixture 115 is diverted by the flow diverter 840*c* toward a highest portion of the peripheral portion 102*b* of the perforated flame holder 102. The mixture 115 is received by all areas of the peripheral portion 102*b* of the perforated flame holder 102. The peripheral portion 102*b* of the perforated flame holder 102 supports a combustion reaction 114 of the mixture 115 of the fuel 112 and the oxidant 110.

According to an embodiment, a portion of the mixture 115 flows uninterrupted in an upward direction toward the central portion 102*a* of the perforated flame holder 102. The central portion 102*a* of the perforated flame holder 102 receives a portion of the mixture 115 of the fuel 112 and the oxidant 110 directly above the output opening 549 of the mixing tube 104. The central portion 102*a* of the perforated flame holder 102 sustains a combustion reaction 114 of the mixture 115 of the fuel 112 and the oxidant 110.

Though FIGS. 8A and 8B illustrate a combustion system 800 that includes a perforated flame holder 102, according to an embodiment the combustion system 800 can include a flame holder 102 other than a perforated flame holder. For example, the combustion system 800 can include a bluff body flame holder including one or more bluff bodies arranged in a shape substantially similar to the shape of the perforated flame holder 102 of FIGS. 8A and 8B, except that the bluff body flame holder includes individual bluff bodies separated from each other by gaps. The bluff bodies can include solid bluff body tiles separated from each other by gaps. The bluff body tiles can hold or support a combustion reaction 114 of the fuel 112 and oxidant 110.

Figure 9A:
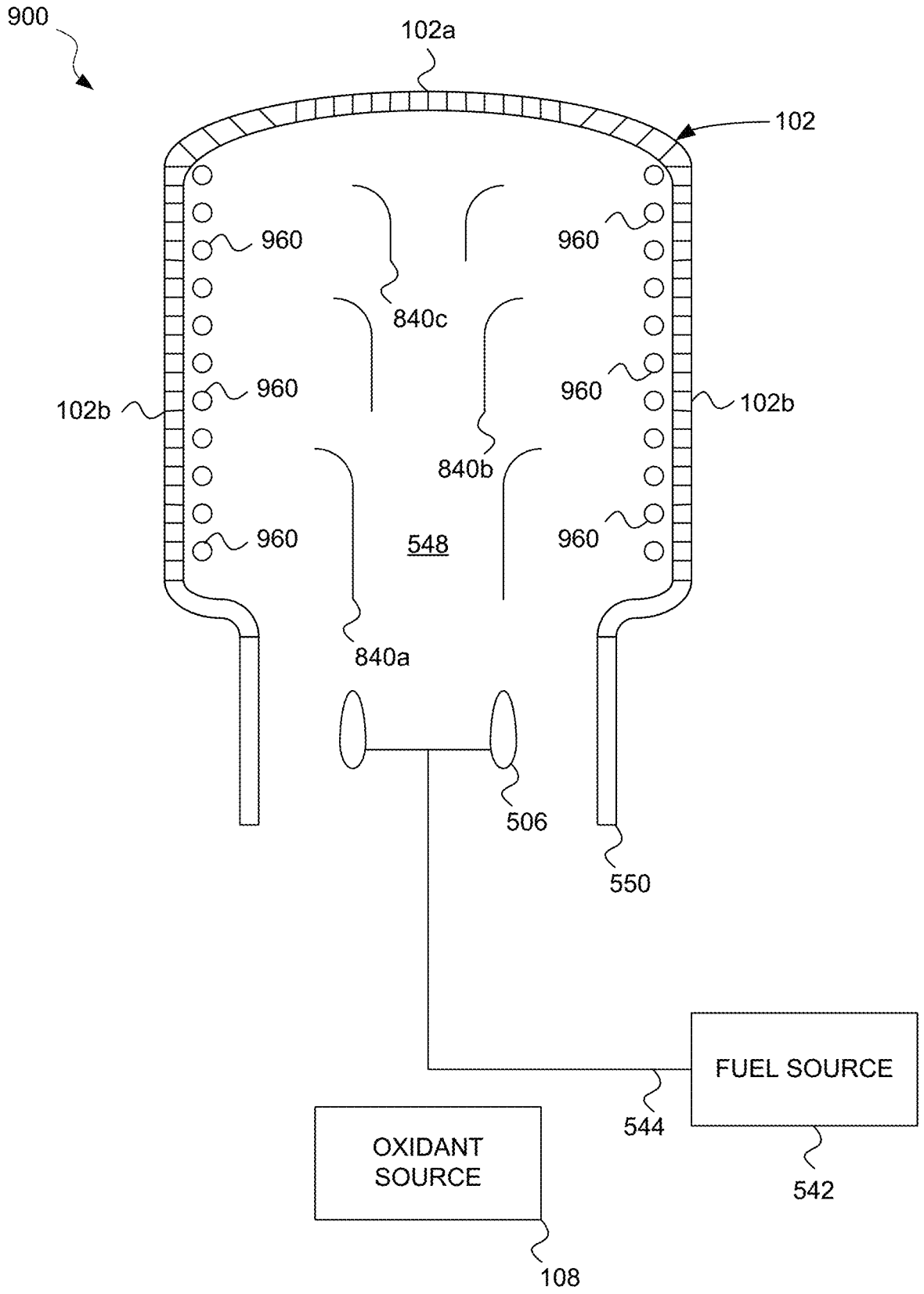
FIG. 9A is a diagram of a combustion system including a mixing tube and a perforated flame holder, according to an embodiment.

FIG. 9A is a diagram of a combustion system 900, according to an embodiment. The combustion system 900 is substantially similar to the combustion system 800 of FIG. 8A and FIG. 8B except that the combustion system 900 includes annular bluff body members 960 positioned between the flow diverters 840*a-c* and the peripheral portion 102*b* of the perforated flame holder 102.

Figure 9B:
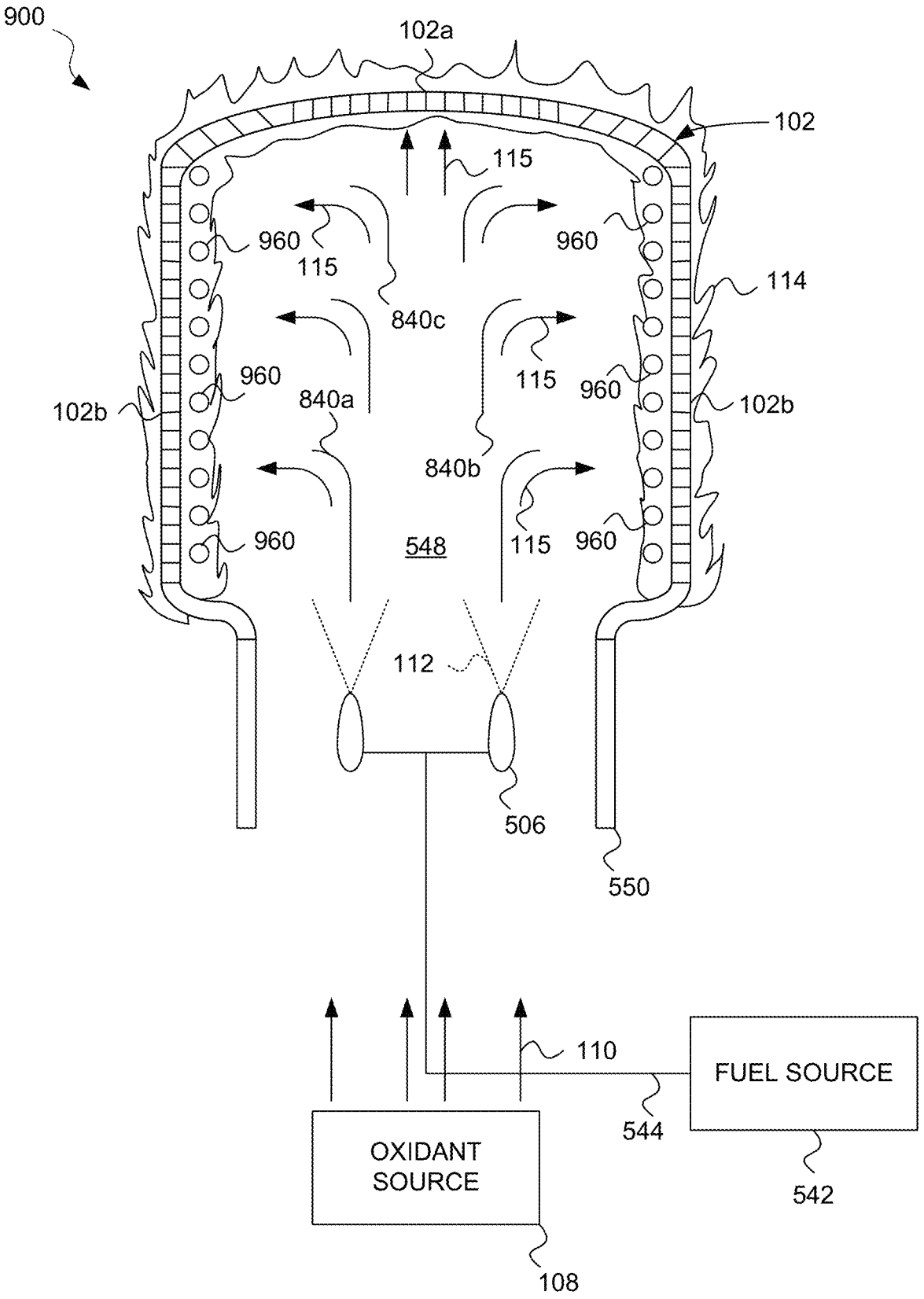
FIG. 9B is a diagram of the combustion system of FIG. 9A in a standard operating state, according to an embodiment.

FIG. 9B is a diagram of the combustion system 900 of FIG. 9A in a standard operating condition, according to an embodiment. In the standard operating condition, the combustion system 900 operates substantially similarly to the combustion system 800 of FIG. 8B in the standard operating condition, according to an embodiment. However, the combustion system 900 includes the bluff body members 960. The bluff body members 960 hold a portion of the combustion reaction 114. The presence of the bluff body members 960 serve to stabilize and enhance the combustion reaction 114. According to an embodiment, the bluff body members 960 hold a majority or all of the combustion reaction 114. According to an embodiment, the bluff body members 960 help to cause the mixture 115 to impinge upon all areas of the peripheral portion 102*b* of the perforated flame holder 102.

Figure 10A:
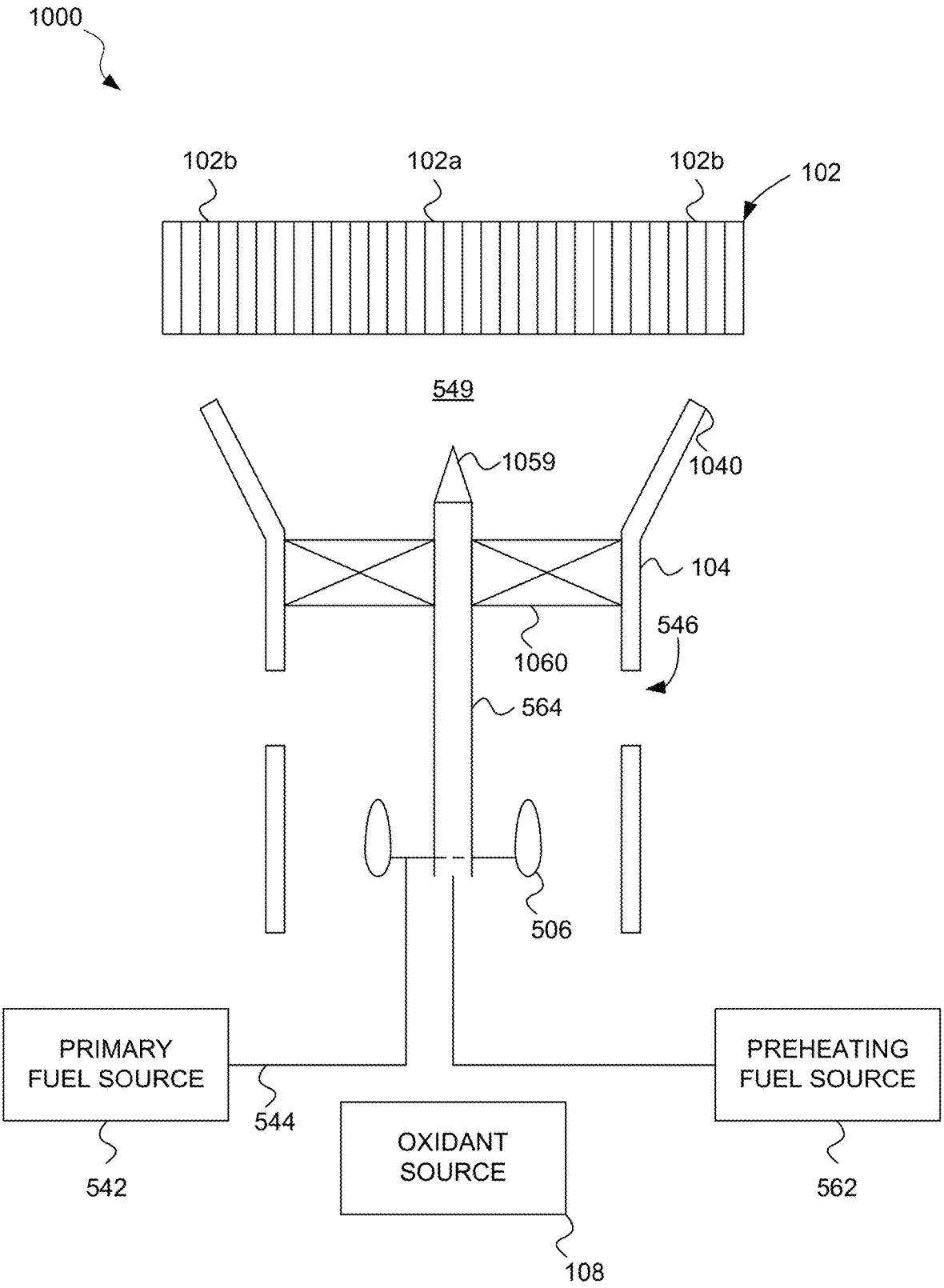
FIG. 10A is a diagram of a combustion system including a mixing tube and a perforated flame holder, according to an embodiment.

FIG. 10A is a diagram of a combustion system 1000, according to an embodiment. The combustion system 1000 includes a perforated flame holder 102, and mixing tube 104, a primary fuel distributor 506, a preheating fuel distributor 1059, an oxidant source 108, a primary fuel source 542, and a preheating fuel source 562, according to an embodiment.

The combustion system 1000 is similar in many ways to the combustion system 500 of FIG. 5A and FIG. 5B, except that the perforated flame holder 102 is flat and does not include a portion that surrounds the mixing tube 104, the presence of the preheating fuel distributor 1059, and the flow diverters 1040.

According to an embodiment, the perforated flame holder 102 includes a central portion 102*a* positioned directly above the output opening 549 of the mixing tube 104. The perforated flame holder 102 also includes a peripheral portion 102*b* positioned peripherally to the output opening 549 of the mixing tube 104.

According to an embodiment, the preheating fuel distributor 1059 is configured to support a swirl stabilized preheating flame 1067 to preheat the perforated flame holder 102 to the threshold temperature. The threshold temperature corresponds to a temperature at which the perforated flame holder 102 can sustain a combustion reaction 114 of the mixture 115 of the fuel 112 and the oxidant 110.

According to an embodiment, the combustion system 1000 includes flow diverters 1040 that angle outwardly from the output opening 549 of the mixing tube 104. The flow diverters 940 are configured to divert a portion of the mixture 115 of the fuel 112 and the oxidant 110 to the peripheral portion 102*b* of the perforated flame holder 102.

Figure 10B:
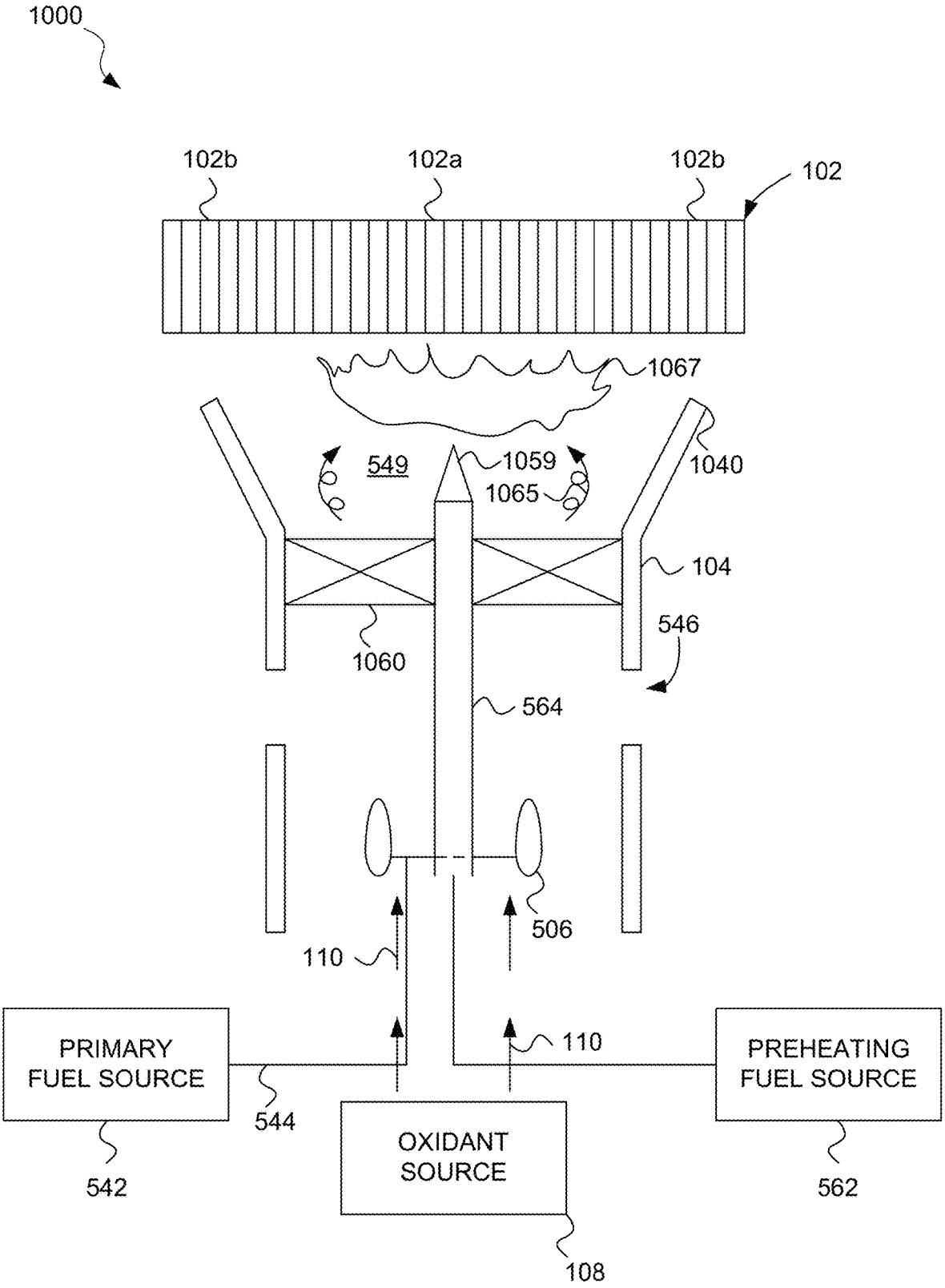
FIG. 10B is a diagram of the combustion system of FIG. 10A in a preheating state, according to an embodiment.

FIG. 10B is a diagram of the combustion system 1000 of FIG. 10A in a preheating state, according to an embodiment. In the preheating state, the oxidant source 108 outputs oxidant 110 into the mixing tube 104. The oxidant 110 passes through a swirler 1060 coupled to a preheating fuel riser 564. The swirler 1060 imparts a swirling motion to the oxidant 110. The preheating fuel source 562 supplies the preheating fuel to the preheating fuel distributor 1059 via the preheating fuel riser 564. The preheating fuel distributor 1059 outputs a preheating fuel that mixes with the swirling oxidant 110, thereby causing a swirling mixture 1065 of the oxidant 110 and the preheating fuel. The combustion system 1000 also includes a pilot flame or an igniter that ignites the preheating flame 1067 from the swirling mixture 1065 of the preheating fuel and the oxidant 110. The preheating flame 1067 heats the perforated flame holder 102 to the threshold temperature. When the perforated flame holder 102 has reached the threshold temperature, the combustion system 1000 transitions to the standard operating condition.

Figure 10C:
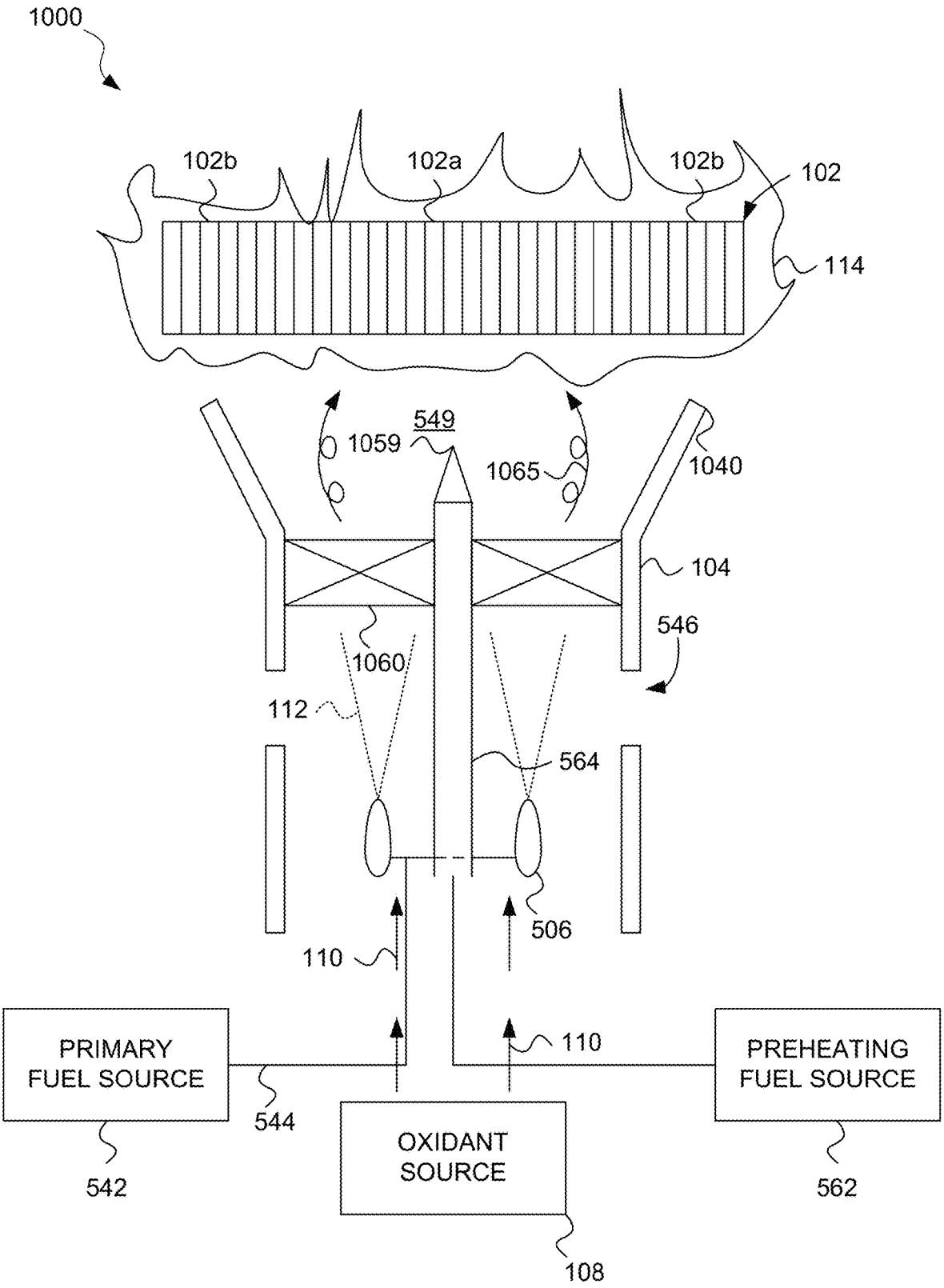
FIG. 10C is a diagram of the combustion system of FIG. 10A in a standard operating state, according to an embodiment.

FIG. 10C is a diagram of the combustion system 1000 of FIG. 10A in a standard operating condition, according to an embodiment. In the standard operating condition, the preheating fuel distributor 1059 has ceased outputting the preheating fuel, thereby causing the preheating flame 1067 to extinguish. The fuel distributor 506 begins outputting the fuel 112. The fuel 112 and the oxidant 110 mix as they travel through the mixing tube 104 toward the perforated flame holder 102. The mixture 115 of the fuel 112 and the oxidant 110 are received by the perforated flame holder 102. The perforated flame holder 102 supports a combustion reaction 114 of the mixture 115 of the fuel 112 and the oxidant 110, according to an embodiment.

According to an embodiment, the mixture 115 of the fuel 112 and the oxidant 110 exits the mixing volume 548 via the output opening 549 of the mixing tube 104, a portion of the mixture 115 of the fuel 112 and the oxidant 110 is diverted outward toward the peripheral portion 102*b* of the perforated flame holder 102. The peripheral portion 102*b* of the perforated flame holder 102 sustains a combustion reaction 114 of the mixture 115 of the fuel 112 and the oxidant 110.

According to an embodiment, a portion of the mixture 115 flows uninterrupted in an upward direction toward the central portion 102*a* of the perforated flame holder 102. The central portion 102*a* of the perforated flame holder 102 receives a portion of the mixture 115 of the fuel 112 and the oxidant 110 directly above the output opening 549 of the mixing tube 104. The central portion 102*a* of the perforated flame holder 102 sustains a combustion reaction 114 of the mixture 115 of the fuel 112 and the oxidant 110.

According to an embodiment, the flue gas 533 exits from the output surface of the perforated flame holder 102. The flue gas 533 can include combustible gases from the combustion reaction 114. The flue gas 533 can also include uncombusted or incompletely combusted fuel 112 and oxidant 110. Portion of the flue gas 533 is recirculated into the mixing tube 104 via the flue gas recirculation apertures 546 in the lower end of the mixing tube 104. The flue gas 533 flows upward through the mixing volume 548 and mixes with the fuel 112 and the oxidant 110. The mixture 115 of the fuel 112, the oxidant 110, and the recirculated flue gas 533 is received at the perforated flame holder 102. The reaction 114. In this way, the combustion system 1000 more completely combusts the fuel 112 and the oxidant 110. This results in a more efficient and cleaner burning combustion system 1000.

Figure 10D:
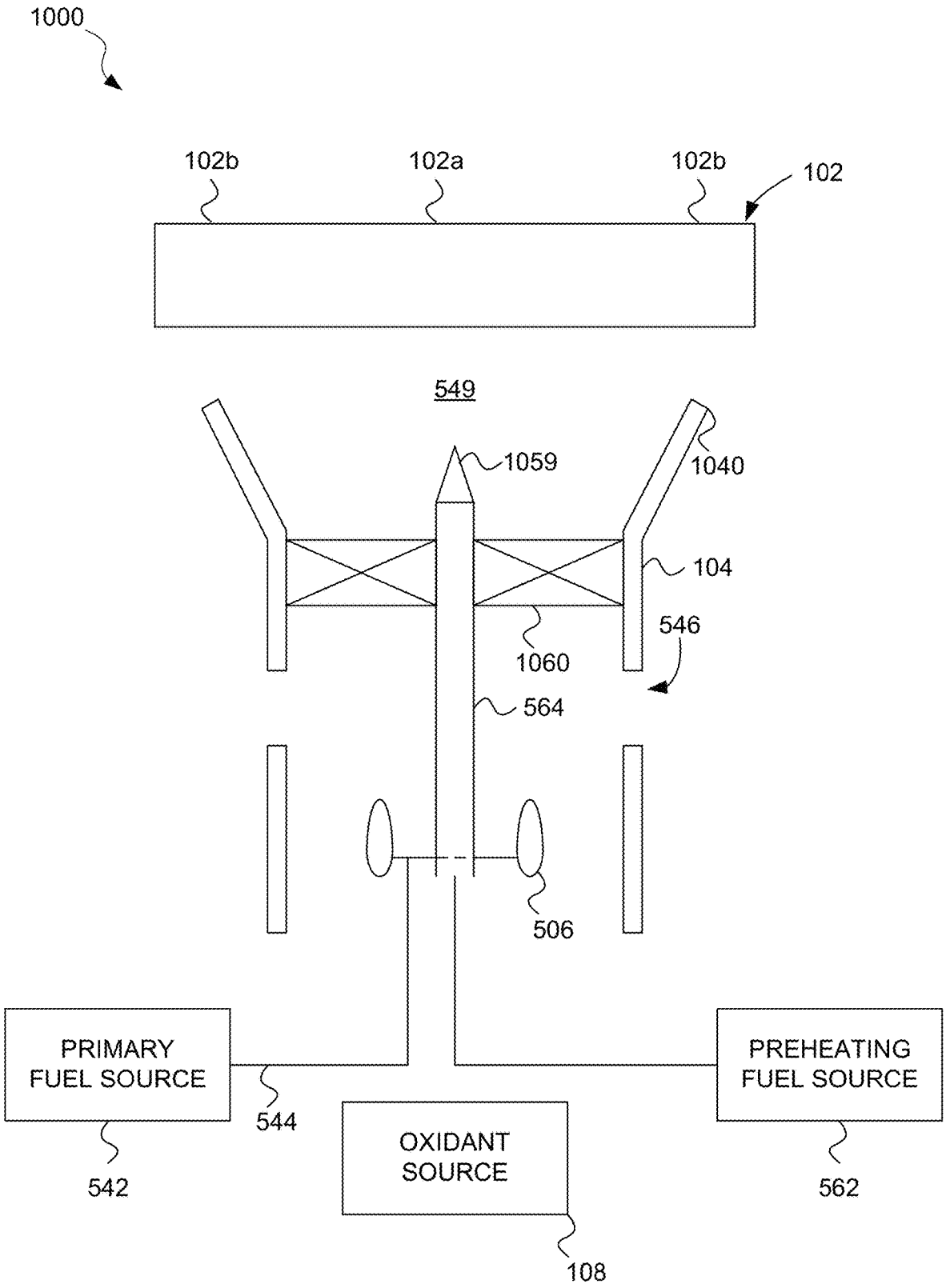
FIG. 10D is a diagram of a combustion system including a mixing tube and a flame holder, according to an embodiment.

FIG. 10D illustrates an embodiment of a combustion system 1000 substantially similar to the combustion system 1000 of FIGS. 10A-10C. The combustion system 1000 includes a flame holder 102. The flame holder 102 can include a bluff body flame holder. The bluff body flame holder can include one or more bluff body tiles making up the central and peripheral portions 102*a*, 102*b*. The bluff body tiles can hold a combustion reaction 114 of the fuel 112 and oxidant 110. The bluff body tiles can be separated from each other by gaps.

Figure 11:
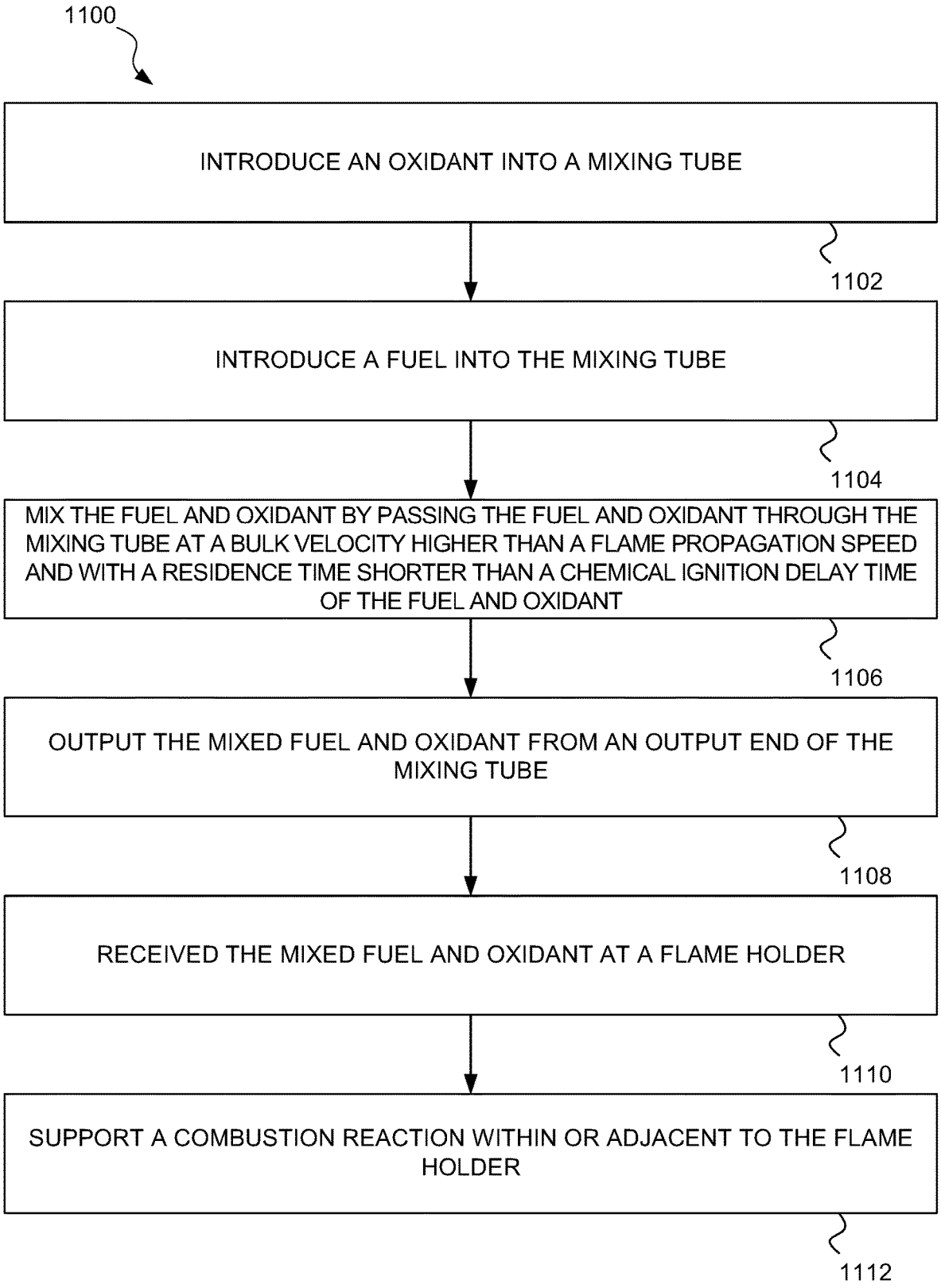
FIG. 11 is a flow diagram of a process for operating a combustion system, according to an embodiment.

FIG. 11 is a flow diagram of a process 1100 for operating a combustion system, according to an embodiment. At 1102, an oxidant is introduced into the mixing tube. At 1104, a fuel is introduced into the mixing tube. At 1106, the fuel and oxidant are mixed by passing the fuel and oxidant through the mixing tube at a bulk velocity higher than a flame propagation speed and with a residence time shorter than the chemical ignition delay time of the fuel and oxidant traversing. At 1108, the mixed fuel and oxidant are output from an output end of the mixing tube. At 1110, the mixed fuel and oxidant are received at the perforated flame holder. At 1112, the combustion reaction is supported within or adjacent to the flame holder.

Figure 12A:
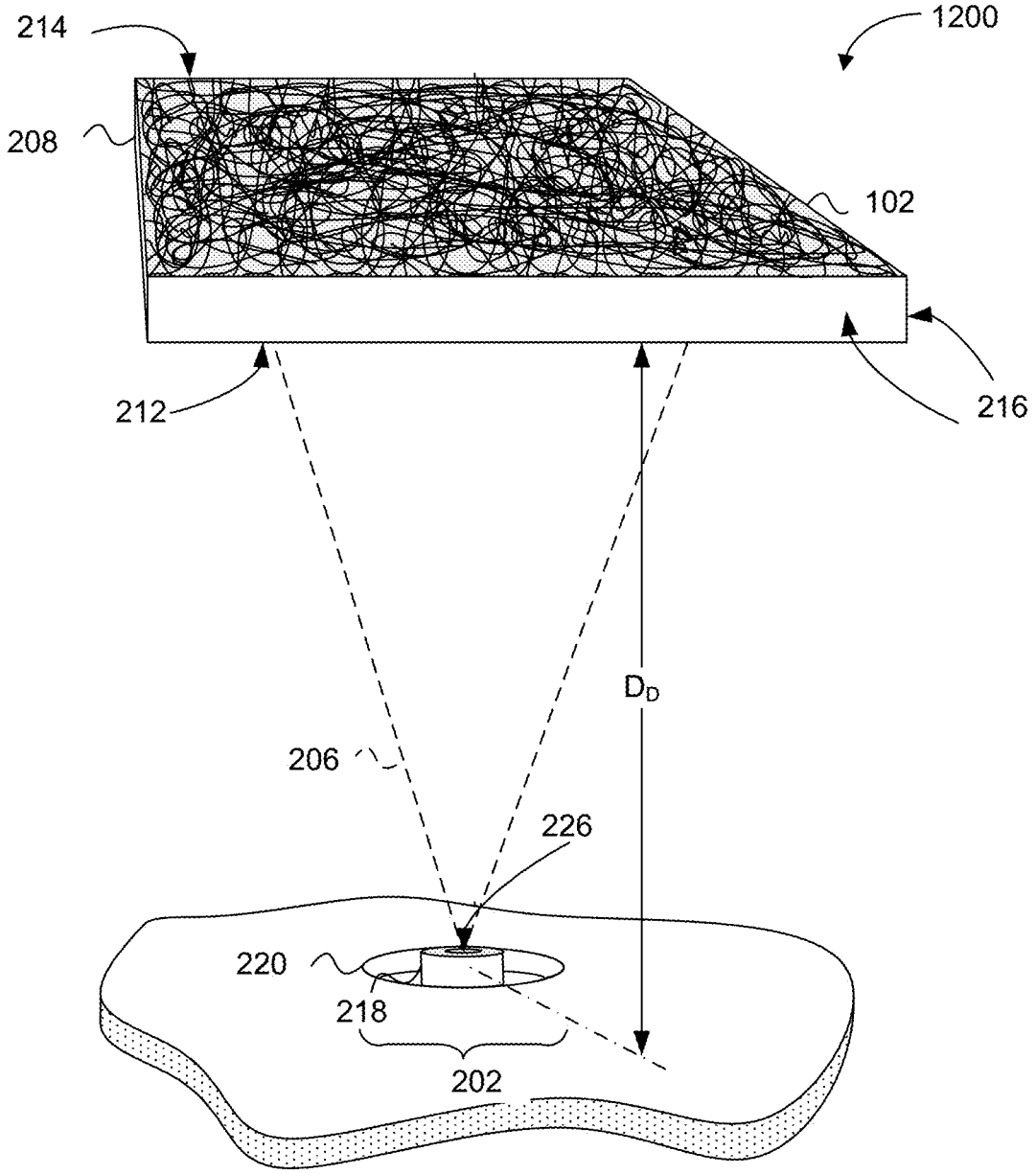
FIG. 12A is a simplified diagram of a burner system, including a perforated flame holder configured to hold a combustion reaction, according to an embodiment.
Figure 12B:
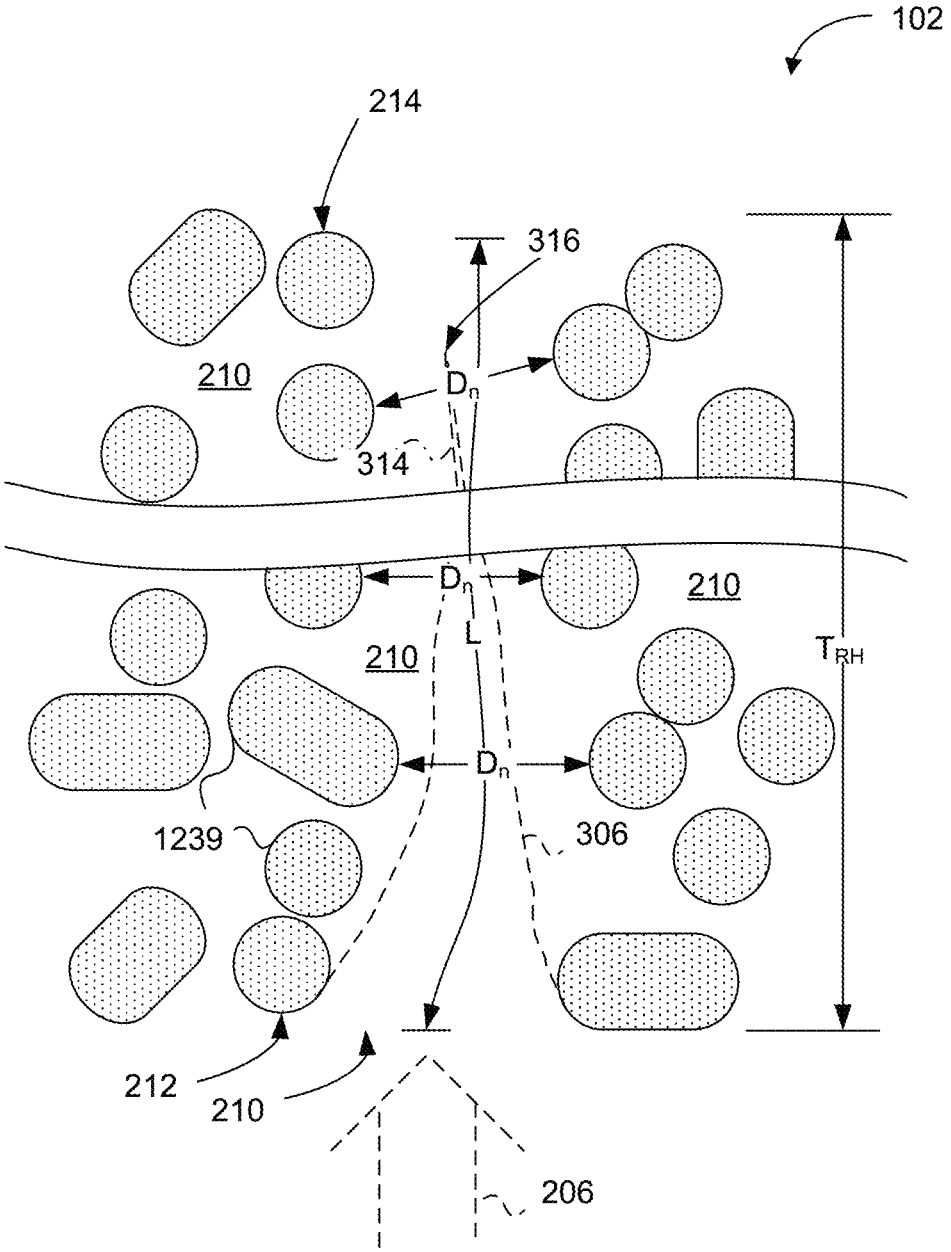
FIG. 12B is a side sectional diagram of a portion of the perforated flame holder of FIG. 12A, according to an embodiment.

FIG. 12A is a simplified perspective view of a combustion system 1200, including another alternative perforated flame holder 102, according to an embodiment. The perforated flame holder 102 is a reticulated ceramic perforated flame holder 102, according to an embodiment. FIG. 12B is a simplified side sectional diagram of a portion of the reticulated ceramic perforated flame holder 102 of FIG. 12A, according to an embodiment. The perforated flame holder 102 of FIGS. 12A, 12B can be implemented in the various combustion systems described herein, according to an embodiment. The perforated flame holder 102 is configured to support a combustion reaction of the fuel and oxidant mixture 206 at least partially within the perforated flame holder 102 between an input face 212 and an output face 214. According to an embodiment, the perforated flame holder 102 can be configured to support a combustion reaction of the fuel and oxidant mixture 206 upstream, downstream, within, and adjacent to the reticulated ceramic perforated flame holder 102.

According to an embodiment, the perforated flame holder body 208 can include reticulated fibers 1239. The reticulated fibers 1239 can define branching perforations 210 that weave around and through the reticulated fibers 1239. According to an embodiment, the perforations 210 are formed as passages between the reticulated ceramic fibers 1239.

According to an embodiment, the reticulated fibers 1239 are formed as a reticulated ceramic foam. According to an embodiment, the reticulated fibers 1239 are formed using a reticulated polymer foam as a template. According to an embodiment, the reticulated fibers 1239 can include alumina silicate. According to an embodiment, the reticulated fibers 1239 can include Zirconia. According to an embodiment, the reticulated fibers 1239 are formed from an extruded ceramic material. According to an embodiment, the reticulated fibers 1239 can be formed from extruded mullite or cordierite. According to an embodiment, the reticulated fibers 1239 can include silicon carbide.

The term "reticulated fibers" refers to a netlike structure. In reticulated fiber embodiments, the interaction between the fuel and oxidant 206, the combustion reaction, and heat transfer to and from the perforated flame holder body 208 can function similarly to the embodiment shown and described above with respect to FIGS. 2-4. One difference in activity is a mixing between perforations 210, because the reticulated fibers 1239 form a discontinuous perforated flame holder body 208 that allows flow back and forth between neighboring perforations 210.

According to an embodiment, the reticulated fiber 1239 network is sufficiently open for downstream reticulated fibers 1239 to emit radiation for receipt by upstream reticulated fibers 1239 for the purpose of heating the upstream reticulated fibers 1239 sufficiently to maintain combustion of a fuel and oxidant mixture 206. Compared to a continuous perforated flame holder body 208, heat conduction paths 312 between reticulated fibers 1239 are reduced due to separation of the reticulated fibers 1239. This may cause relatively more heat to be transferred from the heat-receiving region 306 (heat receiving area) to the heat-output region 310 (heat output area) of the reticulated fibers 1239 via thermal radiation 304.

According to an embodiment, individual perforations 210 may extend between an input face 212 to an output face 214 of the perforated flame holder 102. Perforations 210 may have varying lengths L. According to an embodiment, because the perforations 210 branch into and out of each other, individual perforations 210 are not clearly defined by a length L.

According to an embodiment, the perforated flame holder 102 is configured to support or hold a combustion reaction or a flame at least partially between the input face 212 and the output face 214. According to an embodiment, the input face 212 corresponds to a surface of the perforated flame holder 102 proximal to the fuel nozzle 218 or to a surface that first receives fuel. According to an embodiment, the input face 212 corresponds to an extent of the reticulated fibers 1239 proximal to the fuel nozzle 218. According to an embodiment, the output face 214 corresponds to a surface distal to the fuel nozzle 218 or opposite the input face 212. According to an embodiment, the input face 212 corresponds to an extent of the reticulated fibers 1239 distal to the fuel nozzle 218 or opposite to the input face 212.

According to an embodiment, the formation of the boundary layers 314, transfer of heat between the perforated flame holder body 208 and the gases flowing through the perforations 210, a characteristic perforation width dimension D, and the length L can be regarded as related to an average or overall path through the perforated reaction holder 102. In other words, the dimension D can be determined as a root-mean-square of individual Dn values determined at each point along a flow path. Similarly, the length L can be a length that includes length contributed by tortuosity of the flow path, which may be somewhat longer than a straight line distance TRH from the input face 212 to the output face 214 through the perforated reaction holder 102. According to an embodiment, the void fraction (expressed as (total perforated reaction holder 102 volume—reticulated fiber 1239 volume)/total volume)) is about 70%.

According to an embodiment, the reticulated ceramic perforated flame holder 102 is a tile about 1"×4"×4". According to an embodiment, the reticulated ceramic perforated flame holder 102 includes about 10 pores per inch, meaning that a line laid across the surface of the reticulated ceramic perforated flame holder 102 will cross about 10 pores. Other materials and dimensions can also be used for a reticulated ceramic perforated flame holder 102 in accordance with principles of the present disclosure.

According to an embodiment, the reticulated ceramic perforated flame holder 102 can include shapes and dimensions other than those described herein. For example, the perforated flame holder 102 can include reticulated ceramic tiles that are larger or smaller than the dimensions set forth above. Additionally, the reticulated ceramic perforated flame holder 102 can include shapes other than generally cuboid shapes.

According to an embodiment, the reticulated ceramic perforated flame holder 102 can include multiple reticulated ceramic burner tiles. The multiple reticulated ceramic tiles 112 can be joined together such that each ceramic burner tile is in direct contact with one or more adjacent reticulated ceramic tiles. The multiple reticulated ceramic tiles can collectively form a single perforated flame holder 102. Alternatively, each reticulated ceramic burner tile can be considered a distinct perforated flame holder 102.

As used in the claims, the term perforated flame holder refers to a flame holder that includes a plurality of perforations, in which the perforated flame holder is configured to hold a majority of a combustion reaction within the perforations. For example, on a steady-state basis, more than half the molecules of fuel output into a combustion volume by a fuel and oxidant source may be converted to combustion products between an input face and an output face of the perforated flame holder, or, alternatively, more than half of the heat or thermal energy output by the combustion reaction may be output between the input face and the output face of the perforated flame holder.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a fuel distributor configured to output a fuel;

an oxidant source configured to output an oxidant;

a mixing tube defining a mixing volume aligned to receive the fuel and the oxidant, the mixing tube being shaped to convey the fuel and the oxidant through the mixing volume at a bulk velocity higher than a flame propagation speed, the mixing tube further being sized for a residence time shorter than a chemical ignition delay time of the fuel and the oxidant traversing the mixing volume; and a perforated flame holder aligned to receive a mixture of the fuel and the oxidant from the mixing tube, the flame holder being configured to support a combustion reaction of the mixture of the fuel and the oxidant within or adjacent to the flame holder.

2. The combustion system of claim 1, wherein at least one of the fuel distributor and the oxidant source includes fuel mixing features configured to impart streamwise vortices to the fuel and the entrained oxidant.

3. The combustion system of claim 1, wherein the flame holder is aligned to receive the mixed fuel and oxidant along an axis common to the mixing volume and the flame holder.

4. The combustion system of claim 1, further comprising a flow diverter aligned to receive the mixed fuel and oxidant from the mixing volume and divert the mixed fuel and oxidant through an annular volume along a transport path antiparallel to the bulk velocity and parallel to a mixing tube output axis characteristic of an average mixed fuel and oxidant transport direction from the mixing tube, and wherein the flame holder is arranged circumferentially to the mixing tube and the annular volume such that diverted mixed fuel and oxidant is delivered through the annular volume to an input face of the flame holder.

5. The combustion system of claim 4, wherein the flow diverter comprises a bluff body shaped to effectively reduce the size of an output opening of the mixing tube.

6. The combustion system of claim 4, wherein the input face of the flame holder is cylindrical.

7. The combustion system of claim 4, wherein the input face of the flame holder is faceted.

8. The combustion system of claim 4, wherein the input face of the flame holder is conical.

9. The combustion system of claim 4, wherein the flow diverter includes a flat plate.

10. The combustion system of claim 4, wherein the flow diverter includes a coanda surface.

11. The combustion system of claim 1, wherein the alignment of the mixing tube and the flame holder is axisymmetric.

12. The combustion system of claim 1, wherein the mixing tube includes two parallel wall portions and wherein the flame holder includes two parallel flame holders.

13. The combustion system of claim 1, wherein the flame holder includes a peripheral portion that is positioned peripherally to and spaced away from an output end of the mixing tube, defining an annular volume between the peripheral portion and the output end of the mixing tube.

14. The combustion system of claim 13, further comprising a diverter configured to divert a portion of the mixed fuel and oxidant to the portion of the peripheral portion of the flame holder.

15. The combustion system of claim 14, wherein the peripheral portion of the flame holder at least partially surrounds an outer wall of the mixing tube.

16. The combustion system of claim 14, wherein the peripheral portion of the flame holder includes a cylindrical portion positioned around the mixing tube.

17. The combustion system of claim 15, further comprising a plurality of bluff body members positioned between the outer wall of the mixing tube and the peripheral portion of the flame holder.

18. The combustion system of claim 17, wherein the bluff body members are annular and surround the mixing tube.

19. The combustion system of claim 17, wherein the bluff body members are configured to hold at least a portion of the combustion reaction.

20. The combustion system of claim 1, wherein:

the mixing tube is configured to recirculate flue gas into the mixing volume;

the mixing tube includes one or more flue gas apertures configured to admit flue gas into the mixing volume; and the mixing tube is configured to mix the flue gas with the fuel and the oxidant.

21. The combustion system of claim 1, wherein the flame holder includes a bluff body flame holder.

22. The combustion system of claim 21, wherein the bluff body flame holder includes one or more bluff body tiles.

23. The combustion system of claim 22, wherein the bluff body tiles are separated from each other by gaps.

24. The combustion system of claim 22, wherein the bluff body tiles are non-porous.

25. A method, comprising:

introducing an oxidant into a mixing tube;

introducing a fuel into a mixing tube;

mixing the fuel and the oxidant by passing the fuel and the oxidant through the mixing tube at a bulk velocity higher than a flame propagation speed and with a residence time shorter than a chemical ignition delay time of the fuel and the oxidant traversing;

outputting the mixed fuel and oxidant from an output end of the mixing tube;

receiving the mixed fuel and oxidant at a perforated flame holder; and supporting a combustion reaction within or adjacent to the flame holder.

26. The method of claim 25, further comprising imparting streamwise vortices to the fuel and the entrained oxidant.

27. The method of claim 25, wherein imparting the streamwise vortices includes imparting the streamwise vortices with a fuel distributor.

28. The method of claim 25, further comprising diverting a portion of the mixed fuel and oxidant to a peripheral portion of the flame holder that is positioned peripherally to an output end of the mixing tube.

29. The method of claim 27, further comprising receiving the diverted portion of the mixed fuel and oxidant at the peripheral portion of the flame holder, and wherein supporting the combustion reaction includes supporting a combustion reaction of the diverted portion of the fuel and the oxidant within or adjacent to the peripheral portion of the flame holder.

30. The method of claim 28, wherein diverting the portion of the mixed fuel and oxidant includes passing the diverted portion of the fuel and the oxidant along an outside of the mixing tube in a direction substantially antiparallel to a primary direction of travel of the fuel and the oxidant within the mixing tube.

31. The method of claim 25, further comprising:
circulating flue gas into the mixing tube; and
mixing the flue gas with the fuel and the oxidant within the mixing tube.

32. The method of claim 25, further comprising stabilizing the combustion reaction with one or more bluff body members positioned adjacent to the flame holder.

33. The method of claim 25, wherein the flame holder is a reticulated ceramic perforated flame holder.

34. The method of claim 25, wherein the flame holder is a bluff body flame holder.

35. A combustion system, comprising:
a fuel distributor configured to output a fuel;
an oxidant source configured to output an oxidant;
a mixing tube defining a mixing volume and being aligned to receive the fuel and the oxidant through an input opening thereof, the mixing tube being shaped to convey the fuel and the oxidant to an output opening thereof located at an output end of the mixing tube; and
a flame holder including:
a central portion facing the output end of the mixing tube; and
a peripheral flame holding portion at least partially surrounding the mixing tube and being positioned, outside of the mixing tube, along a non-zero length of the output end of the mixing tube from the output opening of the mixing tube and spaced a non-zero lateral distance away from an outer wall of the mixing tube about the non-zero length, the central portion and the peripheral flame-holding portion each being aligned to receive respective portions of a mixture of the fuel and the oxidant and to support a combustion reaction of the mixture of the fuel and the oxidant within or adjacent to the flame holder.

36. The combustion system of claim 35, wherein the flame holder includes a plurality of bluff body tiles.

37. The combustion system of claim 35, wherein the central portion and the peripheral portion of the flame holder each comprise and together constitute a perforated flame holder and wherein the peripheral portion is configured to support the combustion reaction within or adjacent to perforations defined by the perforated flame holder.

38. A combustion system, comprising:
a fuel distributor configured to output a fuel;
an oxidant source configured to output an oxidant;
a mixing tube defining a mixing volume and being aligned to receive the fuel and the oxidant through an input opening thereof, the mixing tube being shaped to convey the fuel and the oxidant to an output opening thereof located at an output end of the mixing tube; and
a flame holder including:
a central portion facing the output end of the mixing tube; and
a peripheral portion at least partially surrounding the mixing lube and being positioned, outside of the mixing tube, at a level lower than, and spaced away from the output opening of the mixing tube, the central portion and the peroheal portion each being aligned to receive respective portions of a mixture of the fuel and the oxidant and to support a combustion reaction of the mixture of the fuel and the oxidant within or adjacent to the flame holder;
wherein the mixing tube includes a plurality of axially aligned tube segments each including a diverting portion configured to divert a respective portion of the mixed fuel and oxidant to a respective portion of the flame holder.

39. The combustion system of claim 38, wherein the axially aligned tube segments have different diameters.

40. The combustion system of claim 38, wherein the axially aligned tube segments are not in contact with each other.

41. The combustion system of claim 38, wherein at least one of the axially aligned tube segments is shaped like a bell jar.

42. A combustion system, comprising:
a fuel distributor configured to output a fuel;
an oxidant source configured to output an oxidant;
a mixing tube defining a mixing volume and being aligned to receive the fuel and the oxidant, the mixing tube being shaped to convey the fuel and the oxidant through the mixing volume at a bulk velocity higher than a flame propagation speed; and a mixing tube defining a mixing volume and being aligned to receive the fuel and
a perforated flame holder aligned to receive a mixture of the fuel and the oxidant from the mixing tube, the flame holder being configured to support a combustion reaction of the mixture of the fuel and the oxidant within or adjacent to the flame holder.

43. A combustion system, comprising:
a fuel distributor configured to output a fuel;
an oxidant source configured to output an oxidant;
a mixing tube defining a mixing volume and being aligned to receive the fuel and the oxidant, the mixing tube being sized for a residence time shorter than a chemical ignition delay time of the fuel and the oxidant traversing the mixing volume;
a flow diverter that includes a flat plate and a coanda surface; and
a flame holder aligned to receive a mixture of the fuel and the oxidant from the mixing tube, the flame holder being configured to support a combustion reaction of the mixture of the fuel and the oxidant within or adjacent to the flame holder.

* * * * *